US005411846A

United States Patent [19]

Seto et al.

[11] Patent Number: 5,411,846

[45] Date of Patent: May 2, 1995

[54] SILVER HALIDE COLOR PHOTOGRAPHIC MATERIAL

[75] Inventors: Nobuo Seto; Yasuhiro Yoshioka; Masakazu Morigaki, all of Kanagawa, Japan

[73] Assignee: Fuji Photo Film Co., Ltd., Minami Ashigara, Japan

[21] Appl. No.: 94,217

[22] Filed: Jul. 21, 1993

[30] Foreign Application Priority Data

Jul. 23, 1992 [JP] Japan ..... 4-216626

[51] Int. Cl.[6] ..... G03C 7/388; G03C 7/392

[52] U.S. Cl. ..... 430/546; 430/551; 430/613

[58] Field of Search ..... 430/551, 546, 613

[56] References Cited

FOREIGN PATENT DOCUMENTS 2278551 12/1987 Japan ..... 430/551
2284348 12/1987 Japan .
2-100048 4/1990 Japan .

*Primary Examiner*—Lee C. Wright

*Attorney, Agent, or Firm*—Burns, Doane, Swecker & Mathis

[57] ABSTRACT

A novel silver halide color photographic material comprising a support provided thereon at least one layer containing at least one compound represented by the following general formula (A):

In the formula, $L_1$ represents an alkylene or arylene group; $R_1$ represents a substituent which can be substituted for a hydrogen of the benzene ring; m represents an integer 2 to 7; and n is 0 or an integer of 1 to 4, with the proviso that when either or both of m and n are at least two, the plurality of $L_1$ groups and/or $R_1$ groups may be the same or different, and with the proviso that the compound of formula (A) does not form a polymer via an $R_1$ group. In a preferred embodiment, at least one compound represented by formula (A) is incorporated into a photographic silver halide emulsion layer.

16 Claims, No Drawings

SILVER HALIDE COLOR PHOTOGRAPHIC MATERIAL

FIELD OF THE INVENTION

The present invention relates to a silver halide color photographic material. More particularly, the present invention relates to a silver halide color photographic material which is not susceptible to discoloration of dye images obtained by development.

BACKGROUND OF THE INVENTION

In general, a silver halide color photographic material comprises silver halide emulsion layers which are sensitive to three primary colors, i.e., red, green and blue. The material is adapted to be subjected to a so-called substractive color process by which three couplers in the respective emulsion layers are developed to colors complementary to that to which the respective layers are sensitive, to reproduce a color image. The color image obtained by photographic processing of such a silver halide color photographic material normally comprises azomethine dyes or indoaniline dyes produced by the reaction of an oxidation product of an aromatic primary amine color developing agent with a coupler. The color photographic image thus obtained is not necessarily fast to light, moisture and heat, and thus is susceptible to discoloration of dye image and hence deterioration of image quality when exposed to light or stored under the conditions of high humidity and temperature for a prolonged period of time.

Image discoloration is a fatal disadvantage to recording materials. In order to eliminate this disadvantage, various approaches have been proposed. For example, a new coupler which provides a dye having a high fastness has been developed. Further, the use of a discoloration inhibitor has been proposed. Moreover, the use of an ultraviolet absorbent has been proposed to inhibit the deterioration of an image by ultraviolet rays.

Among these approaches, the use of a discoloration inhibitor exerts a great effect of inhibiting the deterioration of an image. For example, the addition of hydroquinones, hindered phenols, catechols, gallic esters, aminophenols, hindered amines, chromanols, indanes, ethers or esters obtained by silylating, acylating or alkylating the phenolic hydroxyl group in these compounds, and metal complexes has been known.

These compounds are considered to serve as dye image discoloration inhibitors. However, they cannot fully meet the customers' growing demand for high image quality. Further, the compounds cause hue change, fog, maldispersion, or microcrystallization after coating of the emulsion. Therefore, the compounds do not go so far as to provide overall excellent effects for color photography.

More particularly, the use of a compound obtained by substituting a phenolic hydroxyl group with an alkyl, as a discoloration inhibitor is proposed in JP-B-56-24257, JB-B-61-46819 (The term "JP-B" as used herein means an "examined Japanese patent publication"), JP-A-56-52747, and JP-A-60-262159 (The term "JP-A" as used herein means an "unexamined published Japanese patent application"). Although all the disclosed compounds exert a discoloration inhibiting effect, they cannot fully meet the strong demand for enhanced image fastness.

SUMMARY OF THE INVENTION

It is therefore an object of the present invention to provide a silver halide color photographic material which is not susceptible to discoloration of a color image for a prolonged period of time, and thus, exhibits a high preservability.

It is another object of the present invention to provide a silver halide color photographic material which comprises a photographic additive that causes no hue change or fog, does not adversely effect color developability, exerts a full inhibiting effect on the discoloration of dye images, and causes no microcrystallization after coating.

It is further object of the present invention to provide a silver halide color photographic material which comprises a photographic additive which exhibits excellent solubility in a high boiling organic solvent, or the like, causes no microcrystallization before or after coating, and does not adversely effect other photographic additives.

It is still a further object of the present invention to provide a silver halide color photographic material which comprises a photographic additive that causes no discoloration of a dye image formed by color development of a coupler, even after being aged for a prolonged period of time, and causes no coloring (yellow stain) of white background of unexposed portions after ageing.

As a result of extensive studies, the inventors found that the aforementioned objects of the present invention can be met by incorporating at least one compound represented by the following general formula (A) in a silver halide color photographic material:

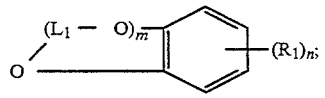

(A)

wherein $L_1$ represents an alkylene or arylene group; $R_1$ represents a substituent which can be substituted for a hydrogen in the benzene ring; m represents an integer of 2 to 7; and n represents 0 or an integer of 1 to 4, with the proviso that when either or both of m and n is/are 2 or more, the plurality of $L_1$ groups and $R_1$ groups, may be the same or different, and that the compound represented by formula (A) does not form a polymer via $R_1$.

DETAILED DESCRIPTION OF THE INVENTION

In formula (A), n is 0 or an integer of 1 to 4. When n is an integer of 1 to 4, $R_1$ represents a substituent which is substituted for a hydrogen atom of the benzene ring. Such substituents include, e.g., an aliphatic group such as methyl and t-octyl, an aromatic group such as phenyl and 2,4-di-t-pentyl, a heterocyclic group such as 4-morpholinyl and pyridyl, an aliphatic acyl group such as acetyl, an aromatic acyl group such as benzoyl, an aliphatic acyloxy group such as acetyloxy, an aromatic acyloxy group such as benzoyloxy, an aliphatic acylamino group such as 2,4-di-t-pentylphenoxyacetylamino, an aromatic acylamino group such as 4-n-dodecyloxybenzoylamino, an aliphatic oxy group such as n-hexadecyloxy, an aromatic oxy group such as 4-n-hexadecyloxyphenoxy, a heterocyclic oxy group such as tetrazolyloxy, an aliphatic oxycarbonyl group such as n-hexadecyloxycarbonyl, an aromatic oxycarbonyl group such as 4-n-hexadecyloxyphenoxycarbonyl, a heterocyclic oxycarbonyl group such as tetrazolyloxycarbonyl, an aliphatic carbamoyl group such as N-octylcarbamoyl, an aromatic carbamoyl group such as N-phenylcarbamoyl, an aliphatic sulfonyl group such as n-dodecanesulfonyl, an aromatic sulfonyl group such as toluenesulfonyl, an aliphatic sulfonyloxy group such as n-dodecanesulfonyloxy, an aromatic sulfonyloxy group such as toluenesulfonyloxy, an aliphatic sulfamoyl group such as N-(2-dodecyloxyethyl)sulfamoyl), an aromatic sulfamoyl group such as N-phenylsulfamoyl, an aliphatic sulfonamido group such as 2,5-di-t-amylphenoxypropylsulfonamido, an aromatic sulfonamido group such as 4-n-dodecyloxyphenylsulfonamido, an aliphatic amino group such as diethylamino, an aromatic amino group such as anilino, an aliphatic sulfinyl group such as n-hexadecanesulfinyl, an aromatic sulfinyl group such as phenylsulfinyl, an aliphatic thio group such as tetradecyloxycarbonylethythio, an aromatic thio group such as phenylthio, an hydroxyl group, a cyano group, a nitro group, a hydroxylamino group, an aliphatic carbamoylamino group such as N-dodecylcarbamoylamino, an aromatic carbamoylamino group such as N-phenylcarbamoylamino, an aliphatic sulfamoylamino group, an aromatic sulfamoylamino group such as N-phenylsulfamoylamino, or a halogen atom such as chlorine. These groups may be further substituted by similar groups. $R_1$ does not form a polymer, i.e., is not connected to any high molecular weight main chain. In the present invention, $R_1$ preferably has no more than 50 carbon atoms.

Aliphatic moiety as defined herein may be a straight-chain, branched or cyclic, saturated or unsaturated aliphatic moiety such as alkyl, alkenyl, alkinyl, cycloalkyl and cycloalkenyl moieties. Such an aliphatic moiety may further have substituents. The aromatic moiety as defined herein represents a hydrocarbon aryl moiety which may further have substituents. The heterocyclic moiety as defined herein represents a saturated or unsaturated ring containing a heteroatom therein and may be a heteroaromatic ring in case of an unsaturated ring. Such a heterocycle moiety may further have substituents. As such substituents there may be used any compounds which can substitute the heterocycle. Examples of such substituents include those defined with reference to $R_1$. Preferred among the aliphatic moieties as defined herein are alkyl and cycloalkyl moieties which may be substituted. Preferred among the aromatic moieties as defined herein is a phenyl moiety which may be substituted.

The compound represented by the general formula (A) is preferably a lipophilic compound. The lipophilic compound as defined herein exhibits a water solubility of from 0 to 10%, preferably from 0 to 5% at room temperature (25° C.).

In the light of the effects of the present invention, m is preferably an integer of 2 to 5, more preferably an integer of 4 to 5, most preferably 5.

In the light of the effects of the present invention, the substituents which can be contained in $R_1$ are preferably an alkyl group, a 5- or 6-membered nitrogen-containing heterocyclic group connected to the benzene ring via a nitrogen atom, an alkylacylamino group, an arylacylamino group, an alkoxy group, an aryloxy group, an alkylsulfonamido group, an arylsulfonamido group, a hydroxyl group, an alkylcarbamoylamino group, an arylcarbamoylamino group, an alkylsulfamoylamino group, or a halogen atom. In particular, if n is 1, $R_1$, or if n is 2 or more, at least one of $R_1$ groups, preferably contains 6 to 50 carbon atoms, more preferably 8 to 36 carbon atoms. The n is preferably 1 or 2.

In the light of the effects of the present invention, the compound represented by the general formula (A) is preferably one represented by the following general formula:

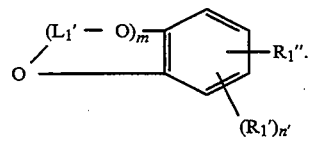

(A-I)

In the general formula (A-I), m is as defined as in general formula (A), including its preferred range. The n' represents 0 or an integer 1 to 3. $R_1'$ represents a substituent having 50 or less carbon atoms which can substitute for a hydrogen atom in the benzene ring. $R_1''$ represents a $C_{6-50}$ substituent which can substitute for a hydrogen atom in the benzene ring. $L_1'$ represents an alkylene or arylene group which carbon atom number contributing to a bonding distance between adjacent oxygen atoms in the unit ether linkage $—L_1'—O—_m$ is 2 or 3, preferably 2. $L_1'$ is more preferably an ethylene, 1-substituted ethylene or o-phenylene group. Substituents to be contained in 1-substituted ethylene group include alkyl group which may be substituted, and phenyl group which may be substituted. The o-phenylene group may be substituted by groups which can substitute for a hydrogen atom in o-phenylene (e.g., those groups defined with reference to $R_1$). Most preferably $L_1'$ is an ethylene or 1-substituted ethylene group.

In the light of the effects of the present invention, the compound represented by the general formula (A-1) is preferably a compound represented by the following general formula:

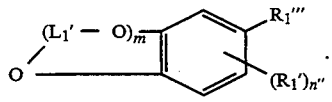

(A-II)

In the general formula (A-II), $R_1'$, $L_1'$ and m are as defined above with respect to general formula (A-I). $R_1'''$ represents a $C_{6-50}$ alkylacylamino group, $C_{6-50}$ arylacylamino group, $C_{6-50}$ alkylsulfonamido group, $C_{6-50}$ arylsulfonamido group, $C_{6-50}$ alkylcarbamoylamino group, $C_{6-50}$ arylcarbamoylamino group, $C_{6-50}$ alkylsulfamoylamino group, or a $C_{6-50}$ 5- or 6-membered nitrogen-containing heterocyclic group connected to the benzene ring via nitrogen atom. The e'' represents 0 or an integer 1 or 2.

The compounds of the present invention do not form a polymer via an $R_1$ group. The polymer as used herein means a compound having a number-average molecular weight of 3,000 or more where $R_1$ is a high molecular main chain. The compounds of the present invention have a molecular weight of from 160 to 2,500, preferably from 200 to 2,000.

Specific examples of compounds according to the present invention represented by the general formula (A) are given below. However, the present invention should not be construed as being limited thereto.

(A-1)
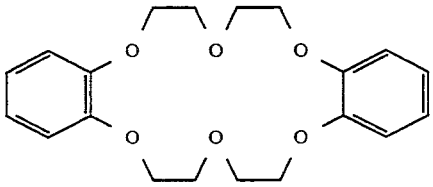
(A-2)
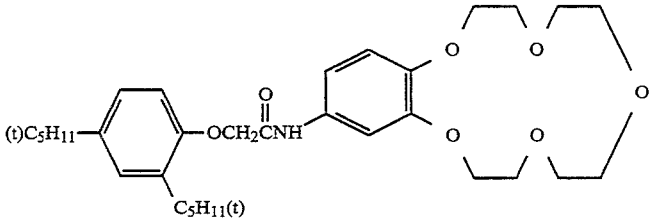
(A-3)
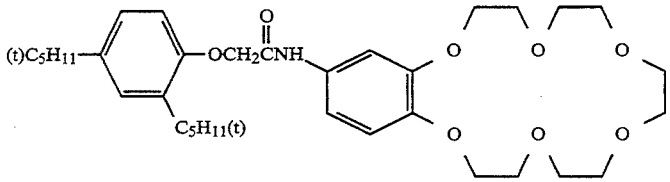
(A-4)
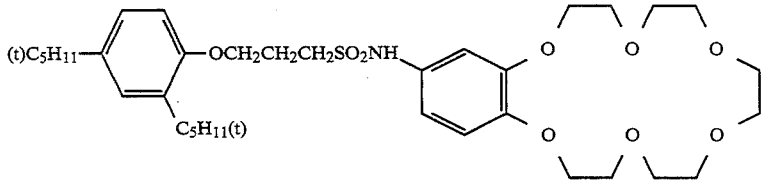
(A-5)
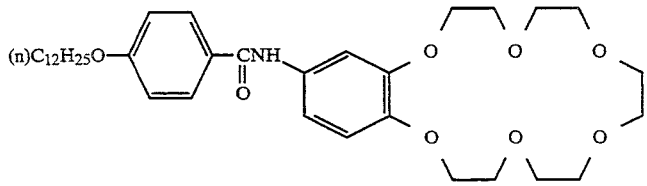
(A-6)
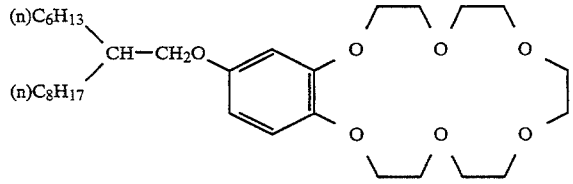
(A-7)
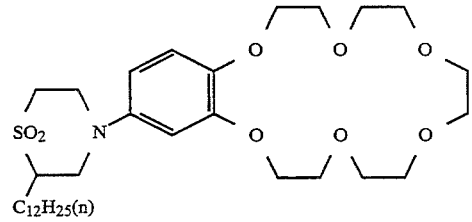
(A-8)
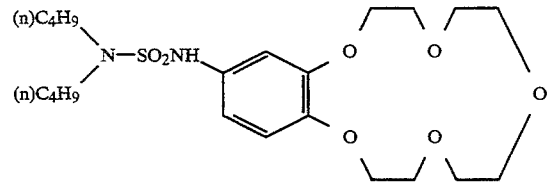

-continued
(A-9)
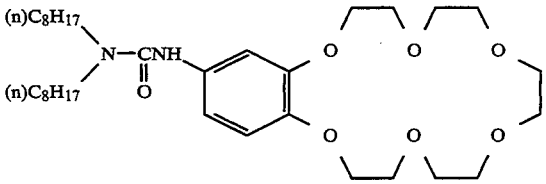
(A-10)
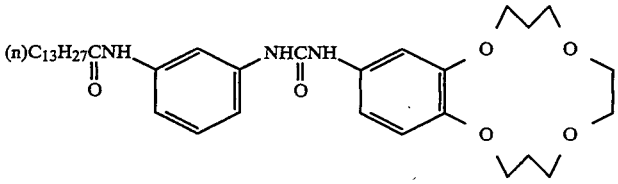
(A-11)
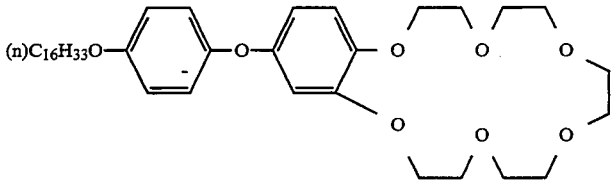
(A-12)
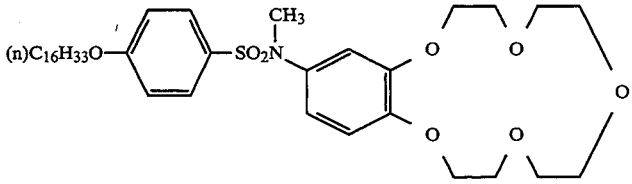
(A-13)
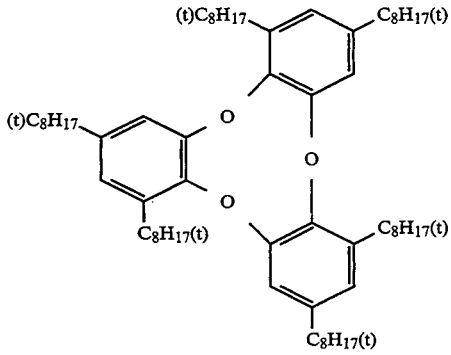
(A-14)
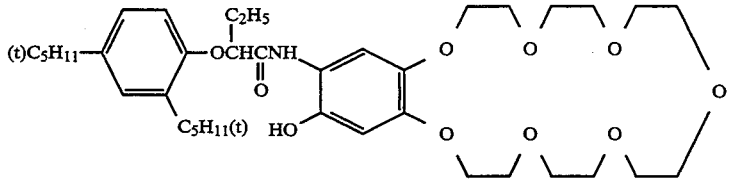
(A-15)
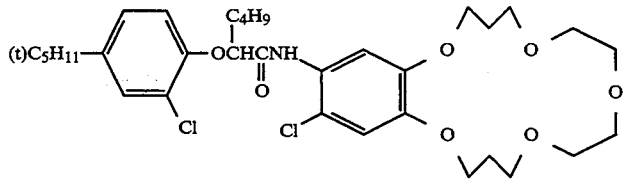

-continued
(A-16)
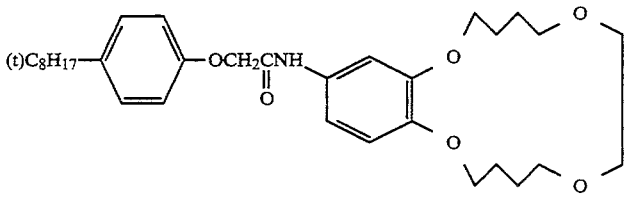
(A-17)
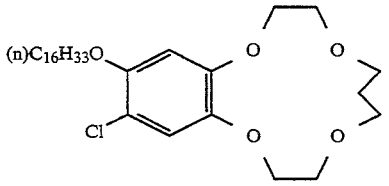
(A-18)
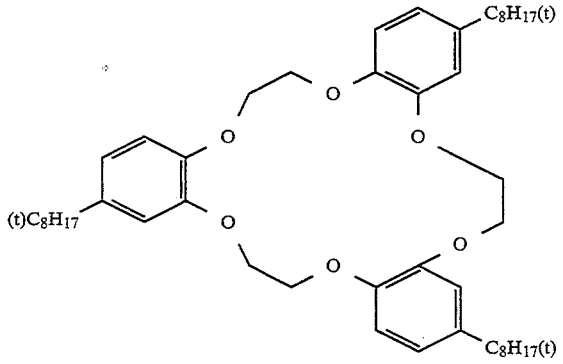
(A-19)
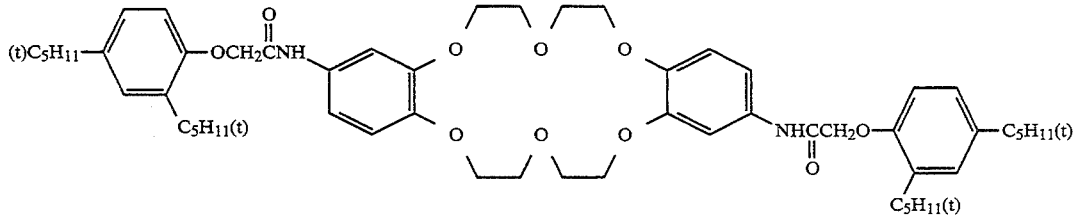
(A-20)
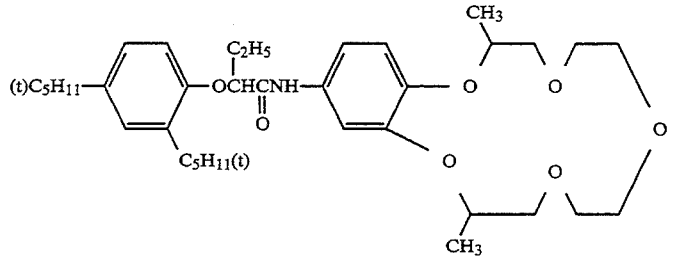
(A-21)
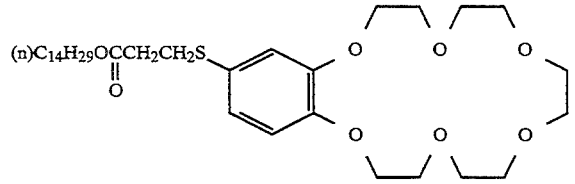

-continued (A-22)

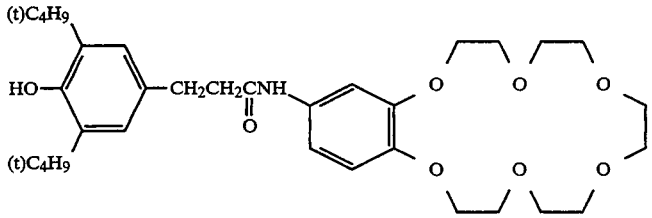

(A-23)

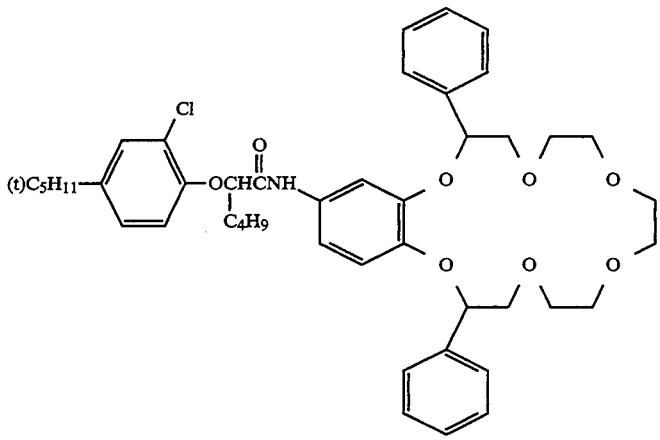

Of these, (A-2)-(A-5), (A-7)-(A-9), (A-12), (A-14) and (A-22) are preferable.

Examples of methods for the synthesis of the compound of the present invention represented by the general formula (A) will be described hereinafter.

The compound of the present invention represented by the general formula (A) can be normally synthesized by etherifying a corresponding dihydroxybenzene to obtain a crown ether compound, and then optionally introducing a hydrophobic group for passivation, or vice versa. A typical example of such a synthesis method will be given below.

Synthesis of Exemplary Compound (A-3)

Exemplary Compound (A-3) was synthesized in accordance with the following synthesis procedure:

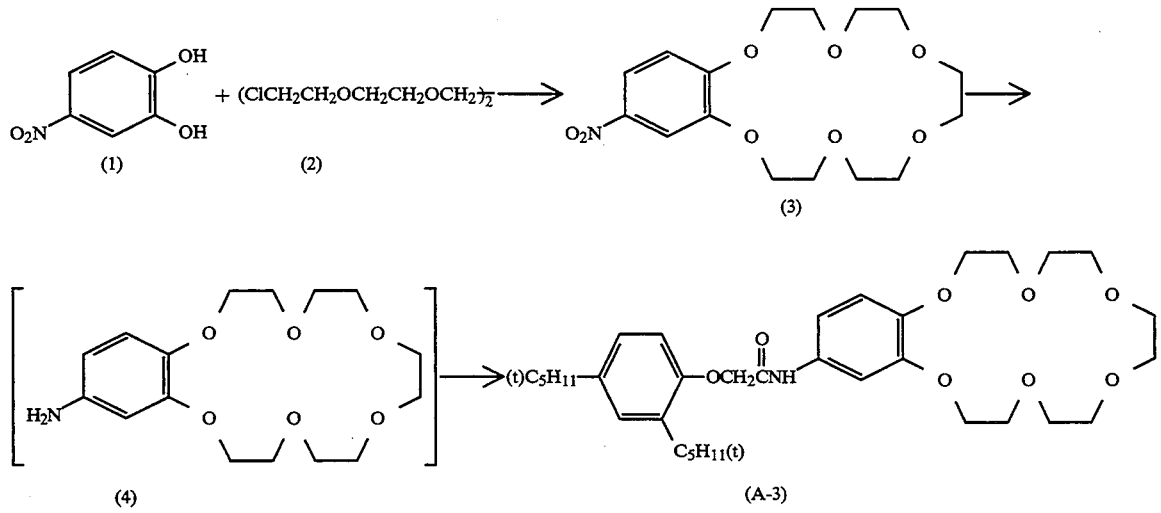

To 5 g of Compound (1) were added 200 ml of dimethylformamide and 8.8 g of anhydrous potassium carbonate. 8.9 g of Compound (2) were then added dropwise to the material with stirring in a stream of nitrogen with the internal temperature thereof maintained at 100° C. in 1 hour. The material was further stirred for 4 hours. The reaction solution was then poured into 200 ml of ice water. Four ml of acetic acid were then added to the material. The material was then extracted with 100 ml of ethyl ester acetate. The resulting ethyl ester acetate phase was washed with 100 ml of saturated brine, and then dried with magnesium sulfate. The magnesium sulfate was then filtered off. The ethyl ester acetate was then distilled off. The residue was then purified through silica gel column chromatography. The material was then crystallized from n-hexane. The crystal was confirmed by infrared spectrum, NMR spectrum and MS spectrum to be Compound (3). (Yield: 4.5 g (45.0%); melting point: 85° to 85° C.)

To 2 g of Compound (3) were added 50 ml of ethanol and 0.2 g of palladium/carbon 10% to make a solution.

In a 200-ml autoclave, the solution was stirred at a temperature of 50° C. with hydrogen gas added thereto (60 kg/cm$^2$) for 2 hours. The system was then returned to normal pressure and temperature. The reaction solution was then filtered out. The ethanol was then distilled off under reduced pressure. To the resulting residue was added 10 ml of acetonitrile to make a solution. The solution was then moved to a reaction vessel. 1.9 g of 2,4-di-t-pentylphenoxyacetyl chloride were added dropwise to the system with stirring with the internal temperature maintained at 23° to 25° C. The system was further stirred for 30 minutes. The reaction solution was then poured into 50 ml of ice water. The material was then extracted with 50 ml of ethyl ester acetate. The resulting ethyl ester acetate phase was washed twice with 50 ml of saturated brine, and then dried with magnesium sulfate. The magnesium sulfate was then filtered off. The ethyl ester sulfate was then distilled off under reduced pressure. The residue was then crystallized from 10 ml of n-hexane to obtain a white crystal. The crystal was confirmed by infrared spectrum, NMR spectrum and MS spectrum to be Exemplary Compound (A-3). (Yield: 2.8 g (83.1%); melting point: 78° to 80° C.)

The compound of the present invention represented by the general formula (A) may be incorporated in at least one layer on a support. In the light of the effects of the present invention, it is preferably incorporated in a photographic silver halide emulsion layer. More preferably, it may be coated in the form of emulsion with a dye-forming coupler.

The compound of the present invention represented by the general formula (A) may be used in combination with a known discoloration inhibitor. In this case, the effect of inhibiting discoloration can be further enhanced. Similarly, two or more kinds of the compound represented by the general formula (A) may be used in combination.

In particular, the compound of the present invention represented by the general formula (A) may be preferably used in the same layer with a yellow coupler, a magenta coupler or a cyan coupler. In the light of the effects of the present invention, it is preferably used in the same layer with a yellow coupler, a magenta coupler or an azole type coupler. If it is incorporated in the same layer as azole type coupler, it may be preferably used in combination with at least one of the hindered amine compounds represented by the general formula (III) in JP-A-1-250955, the general formula (II) in JP-A-2-208653 and the general formula (III) in JP-A-2-217845, the phosphorus compounds represented by the general formula (A-1) in JP-A-1-287564 and the general formula (II) in JP-A-3-25438, the phenolic compounds represented by the general formulae (I) and (II) in JP-A-l-137254, the general formula (A) in JP-A-1-137258, the general formula (III) in JP-A-2-139544, the general formula (II) in JP-A-3-51846, the general formula (II) in JP-A-3-53247, and the general formula (A) in JP-A-3-233448, the cyclic sulfur compounds represented by the general formula (III) in JP-A-113643, and the hydrazine compounds represented by the general formula (A) in JP-A-3-279949, to improve its discoloration inhibiting effect. The amount of such a compound to be used in combination with the compound (A) is preferably in the range specified in the respective patent documents.

The proper amount to be used of compound of general formula (A) depends on the type of coupler, but is normally in the range of 0.5 to 300 mol %, preferably 1 to 200 mol % based on the amount of coupler used, preferably the coupler incorporated in the same layer.

The compound of general formula (A), and the couplers, can be incorporated in the photographic light-sensitive material by various known dispersion methods. An oil-in-water dispersion method is preferably used by which these compounds are dissolved in a high boiling organic solvent (optionally used in combination with a low boiling organic solvent), emulsion-dispersed in an aqueous solution of gelatin, and then incorporated in the silver halide emulsion.

Examples of the high boiling solvent to be used in the oil-in-water dispersion method are disclosed in U.S. Pat. No. 2,322,027. Specific examples of procedure, effects and dipping latex to be used in the latex dispersion method as one of the polymer dispersion methods, are disclosed in U.S. Pat. No. 4,199,363, West German Patent Application (OLS) Nos. 2,541,274, and 2,541,230, JP-B-53-41091, and EP 029104A. An example of organic a solvent-soluble polymer dispersion method is disclosed in PCT W088/00723.

Examples of high boiling organic solvents which can be used in the foregoing oil-in-water dispersion method include phthalic esters such as dibutyl phthalate, dioctyl phthalate, dicyclohexyl phthalate, di-2-ethylhexyl phthalate, didecyl phthalate, bis(2,4-di-tert-amylphenyl-)isophthalate, and bis(1,1-diethylpropyl)phthalate, phosphoric or phosphonic esters such as diphenyl phosphate, triphenyl phosphate, tricresyl phosphate, 2-ethylhexyl diphenyl phosphate, dioctylbutyl phosphate, tricyclohexyl phosphate, tri-2-ethylhexyl phosphate, tridecyl phosphate, and di-2-ethylhexylphenyl phosphate, benzoic esters such as 2-ethylhexyl benzoate, 2,4-dichlorobenzoate, dodecyl benzoate, and 2-ethylhexyl-p-hydroxybenzoate, amides such as N,N-diethyldodecaneamide, and N,N-diethyllaurylamide, alcohols or phenols such as isostearyl alcohol, and 2,4-di-tert-amyphenol, aliphatic esters such as dibutoxyethyl succinate, di-2-ethylhexyl succinate, 2-hexyldecyl tetradecanate, tributyl citrate, diethyl azerate, isostearyl lactate, and trioctyl citrate, aniline derivatives such as N,N-dibutyl-2-butoxy-5-tert-octylaniline, chlorinated paraffins such as paraffins having a chlorine content of 10% to 80%, trimesic esters such as tributyl trimesate, dodecylbenzene, diisopropyl naphthalene, phenols such as 2,4-di-tertamylphenol, 4-dodecyloxyphenol, 4-dodecyloxycarbonylphenol, and 4-(4-dodecyloxyphenylsulfonyl)phenol, carboxylic acids such as 2-(2,4-di-tert-amylphenoxy)butyric acid, 2-ethoxyoctanedecanic acid, and alkylphosphoric acids such as di-2(ethylhexyl)phosphoric acid, and diphenylphosphoric acid. As auxiliary solvents there may be used organic solvents having a melting point of 30° C. to about 160° C., such as ethyl acetate, butyl acetate, ethyl propionate, methyl ethyl ketone, cyclohexanone, 2-ethoxyethyl acetate, and dimethylformamide.

The foregoing high boiling organic solvents can be used in amounts of 0 to 5.0 times, preferably 0 to 1.0 times, the weight of coupler.

As silver halide emulsions and other materials (additives) to be incorporated in the photographic light-sensitive material of the present invention, photographic constituent layers of the photographic light-sensitive material of the present invention (e.g., layer configuration), and processing methods and processing additives to be used in the processing of the photographic light-sensitive material of the present invention there can be preferably used those described in the following patents, particularly European Patent 0,355,660A2:

TABLE 1

| Photographic constituent | JP-A-62-215272 | JP-A-2-33144 | EPO,355,660A2 |
|---|---|---|---|
| Silver halide emulsion | Line 6, upper right column, p. 10 - line 5, lower left column, p. 12/ last line 4, lower right column, p. 12 line left column, p. 13 | Line 16, upper right column, p. 28 - line 11, lower right column, p. 29/ line 2–5, p. 30 - 17, upper | Line 53, p. 45 line 3, p. 47/ line 20–22, p. 47 |
| Silver halide solvent | Line 6–14, lower left column, p. 12/ last line 3, upper right column - last line, lower left column, p. 18 | — | |
| Chemical sensitizer | Last line 3, lower right column - last line 5, lower right column p. 12/line 1, lower right column, p. 18 - last line 9, upper right column, p. 22 | Line 12 - last line, lower right column, p. 29 | Line 4 - 9, p. 47 |
| Spectral sensitizer (spectral | Last line 8, upper right column, p. 22 - last line, p. 38 | Line 1–13, upper left column, p. 30 | Line 10 - 15, p. 47 |
| Emulsion stabilizer | Line 1, upper left column, p. 39 - last line, upper right column, p. 72 | Line 14, upper left column - line 1, upper right, p. 30 | Line 16–19, p. 47 |
| Development accelerator | Line 1, lower left column, p. 72 - line 3, upper right column, p. 91 | — | — |
| Color coupler (cyan, magenta, yellow coupler) | Line 4, upper right column, p. 91 - line 6, upper left column, p. 121 | Line 14, upper right column, p. 3 - last line, upper left column, p. 35 | Line 15–27, p. 4/line 30, p. 5 - last line, p. 28/ line 29 31, p. 45/line 23, p. 47 line 50, p. 63 |
| Color intensifier | Line 7, upper left column, p. 121 line 1, upper right column, p. 125 | | |
| Ultraviolet absorbent | Line 2, upper right column, p. 125 - last line, lower left column, p. 127 | Line 14, upper right column, p. 37 - line 11, upper left column, p. 38 | Line 22–31, p. 65 |
| Discoloration inhibitor (image stabilizer) | Line 1, lower right column, p. 127 - line 8, lower left column, p. 137 | Line 12, upper right column, p. 36 - line 19, upper lower column, p. 37 p. 45/line 2 - 21, p. 65 | Line 30, p. 4 - line 23, p. 5/ line 1, p. 29 - line 25, p. 45/ line 33–40, |
| High boiling and/or low boiling organic solvent | Line 9, lower left column, p. 137 - last line, upper right column, p. 144 | Line 14, lower right column, p. 35 - last line 4, upper left column, p. 36 | Line 1–51, p. 64 |
| Process for dispersion of photo-graphic additives | Line 1, lower left column, p. 144 - line 7, upper right column, p. 146 p. 28/line 12, | Line 10, lower right column, p. 27 - last line, upper left column, | Line 51, p. 63 - line 56, p. 64 |

TABLE 1-continued

| Photographic constituent | JP-A-62-215272 | JP-A-2-33144 | EPO,355,660A2 |
|---|---|---|---|
| | lower right column - line 71 upper right column, p. 36 | | |
| Film hardener | Line 8, upper right column, p. 146 - line 4, lower left column, p. 155 | — | — |
| Developing agent precursor | Line 5, lower left column, p. 155 line 2, lower right column, p. 155 | — | — |
| Development inhibitor-releasing compound | Line 3–9, lower right column, p. 155 | — | — |
| Support | Line 19, lower right column, p. 155 - line 14, upper left column, p. 156 | Line 18, upper right column, p. 38 - line 3, upper left column, p. 39 | Line 29, p. 66 line 13, p. 67 |
| Constitution of light-sensitive layer | Line 15, upper left column, p. 156 - line 14, lower right column, p. 156 | Line 1–15, upper right column, p. 28 | Line 41–52, p. 45 |
| Dye | Line 15, lower right column, p. 156 - last line, lower right column, p. 184 | Line 12, upper left column, - line 7, upper right column, p. 38 | Line 18 - line 22, p. 66 |
| Discoloration inhibitor | Line 1, upper left column, p. 185 - line 3, lower right column, p. 188 | Line 8–11, upper right column, p. 36 | Line 57, p. 64 line 1, p. 65 |
| Gradation adjustor | Line 4–8, lower right column, p. 188 | — | — |
| Stain inhibitor | Line 9, lower right column, p. 188 - line 10, lower right column, p. 193 | Last line, upper left column - line 13, lower right column, p. 37 | Line 32, p. 65 line 17, p. 66 |
| Surface active agent | Line 1, lower left column, p. 201 - last line, upper right column, p. 210 | Line 1, upper right column, p. 18 - last line, lower right column, p. 24/last line 10, lower left column - line 9, lower right column, p. 27 | — |
| Fluorine-containing compound (antistatic agent,coating aid,lubricant, adhesion inhibitor) | Line 1, lower left column, p. 210 - line 5, lower left column, p. 222 | Line 1, upper left column, p. 25 line 9, lower right column, p. 27 | — |
| Binder (hydrophilic colloid) | Line 6, lower left column, p. 222 - last line, upper left column, p. 225 | Line 8–18, upper right column, p. 38 | Line 23–28, p. 66 |
| Thickening agent | Line 1, upper right column, p. 225 - line 2, upper right column, p. 227 | — | — |
| Antistatic agent | Line 3, upper right column, p. 227 line 1, upper left column, p. 230 | — | — |
| Polymer latex | Line 2, upper left column, p. 230 last line, p. 239 | — | — |
| Matting | Line 1, upper left | — | — |

TABLE 1-continued

| Photographic constituent | JP-A-62-215272 | JP-A-2-33144 | EPO,355,660A2 |
|---|---|---|---|
| agent | column, p. 240 - last line, upper right column, p. 240 | | |
| Photographic processing method (processing step, additive, etc.) | Line 7, upper right column, p. 3 - line 5, upper right column, p. 10 | Line 4, upper left column, p. 39 - last line, upper left column, p.42 | Line 14, p. 67 line 28, p. 69 |

(Note) The contents cited in JP-A-62-215272 include the contents described in the written amendment of procedure dated March 16, 1987 attached thereto.
Among the above mentioned color couplers, as yellow couplers there may also be preferably used short wave type yellow couplers as disclosed in JP-A-63-231451, 63-123047, 63-241547, 1-173499, 1-213648, and 1-250944.

As the silver halide to be used in the present invention there can be used silver chloride, silver bromide, silver bromochloride, silver bromochloroiodide, silver bromoiodide, or the like. In particular, for the purpose of rapid processing, silver bromochloride containing substantially no silver iodide and having a silver chloride content of 90 mol % or more, preferably 95 mol % or more, particularly 98 mol % or more or a pure silver chloride emulsion may be preferably used.

The photographic light-sensitive material of the present invention may preferably comprise a dye decolorable upon processing (particularly an oxonol dye) as disclosed in EP 0,337,490A2, pp. 27–76, in the hydrophilic colloidal layer in such an amount that the optical reflective density of the photographic light-sensitive material at 680 nm is 0.70 or more or titanium oxide surface-treated with a divalent, trivalent or tetravalent alcohol (e.g., trimethylolethane) in a water-resistant resin layer in the support in an amount of 12% by weight or more, more preferably 14% by weight or more, for the purpose of enhancing the image sharpness or the like.

The photographic light-sensitive material of the present invention may preferably comprise a dye preservability-improving compound, as disclosed in EP 0,277,589A2, in combination with couplers, particularly pyrazoloazole magenta couplers.

In particular, Compound (A) as disclosed in EP 0,277,589A2, which undergoes chemical bonding to an aromatic amine developing agent remaining after color development to produce a chemically inert and substantially colorless compound, and/or Compound (B) as disclosed in EP 0,277,589A2 which undergoes chemical bonding to an oxidation product of an aromatic amine color developing agent remaining after color development to produce a chemically inert and substantially colorless compound, may be preferably used singly or in combination to inhibit the occurrence of stain or other side effects caused by the formation of developed dyes by the reaction of a color developing agent or its oxidation product remaining in the film with a coupler in storage after processing.

The light-sensitive material of the present invention may preferably comprise an anti-mold agent as disclosed in JP-A-63-271247. Various mold and bacteria can propagate in the hydrophilic colloidal layer and deteriorate the image.

As the support to be used in the light-sensitive material of the present invention there can be used a white polyester support for display, or a support comprising a white pigment-containing layer on the silver halide emulsion layer side. In order to further improve image sharpness, an antihalation layer may be preferably coated on the silver halide emulsion side or opposite side of the support. In order to enable display through reflected light or transmitted light, the transmission density of the support is preferably adjusted to a range of 0.35 to 0.8.

The light-sensitive material of the present invention may be exposed to visible light or infrared light. Exposure may be carried out by a low intensity exposure process or a high intensity short time exposure process. In the latter case, a laser scanning exposure process with an exposure time of $10^{-4}$ seconds per pixel may be preferably used.

For exposure, a band stop filter as disclosed in U.S. Pat. No. 4,880,726 may be preferably used. This removes light stain, remarkably improving the color reproducibility.

The present invention is preferably applied to a photographic light-sensitive material which does not comprise a developing agent (paraphenylenediamine derivative) before the photographic processing such as color paper, color reversal paper, direct positive color photographic light-sensitive material, color negative film, color positive film and color reversal film. Preferably, the present invention can be applied to color photographic light-sensitive materials having a reflective support (e.g., color paper, color reversal paper) or color photographic light-sensitive materials adapted to form a positive image (e.g., direct positive color photographic material, color positive film, color reversal film), particularly color photographic light-sensitive materials having a reflective support.

In the implementation of the present invention, the foregoing compounds and couplers are preferably used in combination with cyan dye-forming couplers, magenta dye-forming couplers and yellow dye-forming couplers which undergo reaction with an oxidation product of an aromatic primary amine color developing agent to develop cyan, magenta and yellow, respectively.

These couplers may be either two-equivalent or four-equivalent to silver ion, or may be polymeric or oligomeric. The couplers may be used singly or in combination.

Preferred couplers used with the compounds represented by the formula (A) will be explained hereunder.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Publication No. 3,329,729, European Patents 121,365A 249,453A, and 333,185A2 and JP-A-61-42658. Further, azole couplers as disclosed in JP-A-64-553, JP-A-64-554, JP-A-64-555, JP-A-64-556, JP-A-4-333843 and JP-A-5-150426 and European Patent Publication Nos. 0488248, and 0491197, imidazole couplers as disclosed in U.S. Pat. No. 4,818,672 and JP-A-2-33144 and cyclic active methylenic cyan couplers as disclosed in JP-A-64-32260 can be used.

Preferred examples of cyan couplers include Couplers (C-I) and (C-II) disclosed in JP-A-2-139544, lower left column, page 17—lower right column, page 20, and couplers as disclosed in European Patent Publication Nos. 0488248, and 0491197.

Preferred magenta couplers include 5-pyrazolone compounds and pyrazoloazole compounds. More preferred are those described in U.S. Pat. Nos. 4,310,619, 4,351,897, 3,061,432, 3,725,064, 4,500,630, 4,540,654, and 4,556,630, European Patent 73,636, JP-A-60-33552, JP-A-60-43659, JP-A61-72238, JP-A-60-35730, JP-A-55-118034, and JP-A-60-185951, RD Nos. 24220 (June 1984) and 24230 (June 1984), and W088/04795.

Particularly preferred examples of magenta couplers include pyrazoloazole magenta couplers of the general formula (I) disclosed in JP-A-2-139544, lower right column, page 3—lower right column, page 10, and 5-pyrazolone magenta couplers of the general formula (M-1) disclosed in JP-A-2-139544, lower left column, page 17—upper left column, page 21. Most preferred among these magenta couplers are the foregoing pyrazoloazole magenta couplers.

As yellow couplers there can be used those described in U.S. Pat. Nos. 3,933,501, 4,022,620, 4,326,024, 4,401,752, 4,248,961, 3,973,968, 4,314,023, and 4,511,649 JP-B-58-10739, British Patents 1,425,020, and 1,476,760, European Patent 249,473A, and JP-A-63-23145, JP-A-63-123047, JP-A-1-250944, and JP-A-1-213648, so long as they do not impair the effects of the present invention.

Particularly preferred examples of yellow couplers include yellow couplers of the general formula (Y) in JP-A-2-139544, upper left column, page 18—lower left column, page 22, acylacetamide yellow couplers characterized by acyl group as disclosed in JP-A-5-2248, and European Patent Disclosure No. 0447969, and yellow couplers of the general formula (Cp-2) in JP-A-5-27389, and European Patent ~ Publication No. 0446863A2.

Compounds capable of releasing a photographically useful residue upon coupling can also be used in the present invention. Preferred examples of DIR couplers, which release a development inhibitor, are described in the patents cited in RD No.17643, VII-F, JP-A-57-151944, JP-A-57-154234, JP-A60-184248, JP-A-63-37346, and JP-A-63-37350, and U.S. Pat. Nos. 4,248,962, and 4,782,012.

Couplers capable of imagewise releasing a nucleating agent or a developing accelerator at the time of development preferably include those described in British Patents 2,097,140 and 2,131,188, and JP-A-59-157638 and JP-A-59-170840.

Other examples of couplers which can be incorporated in the photographic material according to the present invention include competing couplers as described in U.S. Pat. No. 4,130,427, polyequivalent couplers as described in U.S. Pat. Nos. 4,283,472, 4,338,393, and 4,310,618, DIR redox compound-releasing couplers, DIR coupler-releasing couplers, DIR coupler-releasing redox compounds or DIR redox-releasing redox compounds as described in JP-A-60-185950 and JP-A-62-24252, couplers capable of releasing a dye which returns to its original color after release as described in European Patents 173,302A, bleach accelerator-releasing couplers as disclosed in RD Nos. 11449, and 24241, and JP-A-61-201247, couplers capable of releasing a ligand as described in U.S. Pat. No. 4,553,477, couplers capable of releasing a leuco dye as described in JP-A-63-75747, and couplers capable of releasing a fluorescent dye as described in U.S. Pat. No. 4,774,181.

The standard amount of such a color coupler to be used in the present invention is in the range of 0.001 to 1 mol, preferably 0.01 to 0.5 mol for yellow couplers, 0.003 to 0.3 mol for magenta couplers and 0.002 to 0.3 mol for cyan couplers, per mol of photographic silver halide.

Typical examples of couplers which can be used in the present invention are given below.

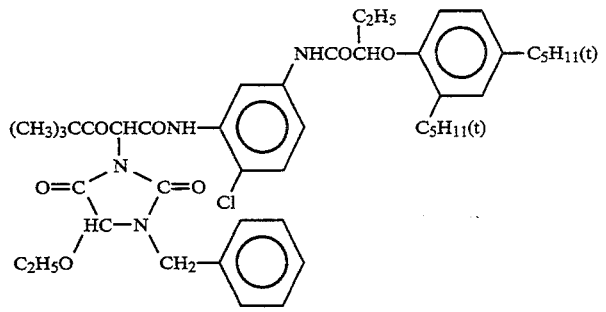

(Y-1)

-continued
(Y-2)
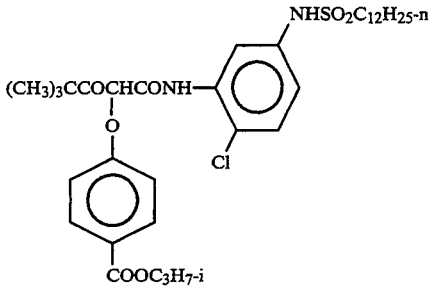
(Y-3)
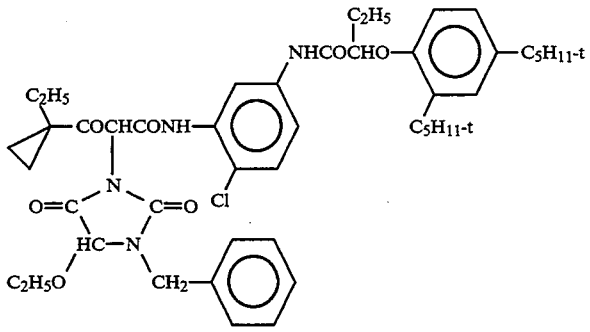
(Y-4)
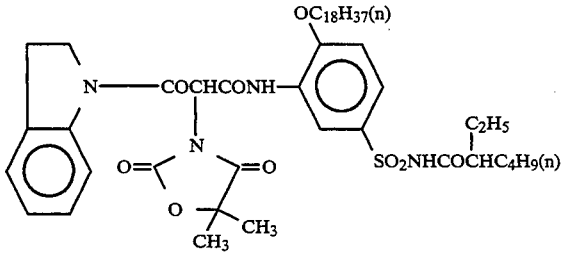
(Y-5)
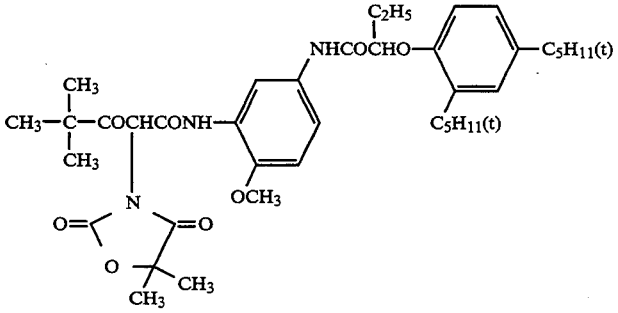
(Y-6)
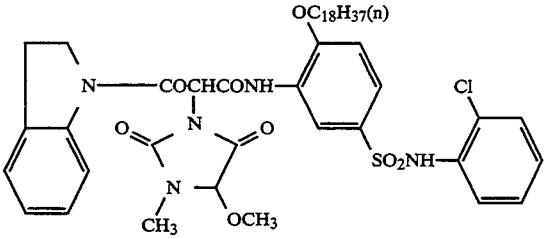

-continued
(Y-7)
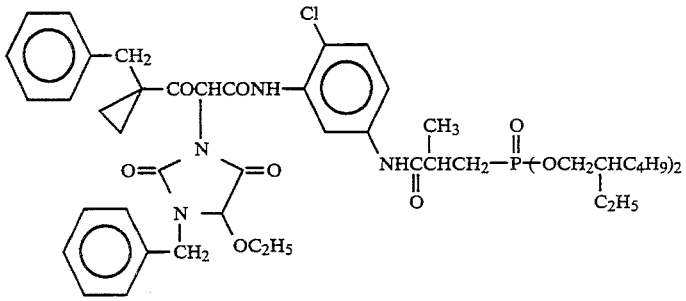
(M-1)
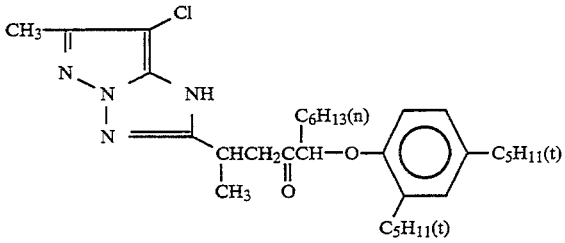
(M-2)
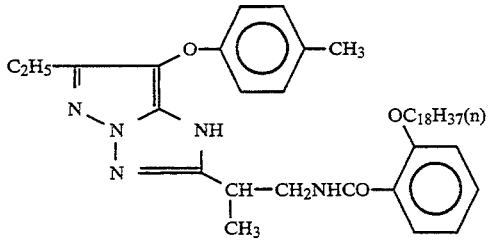
(M-3)
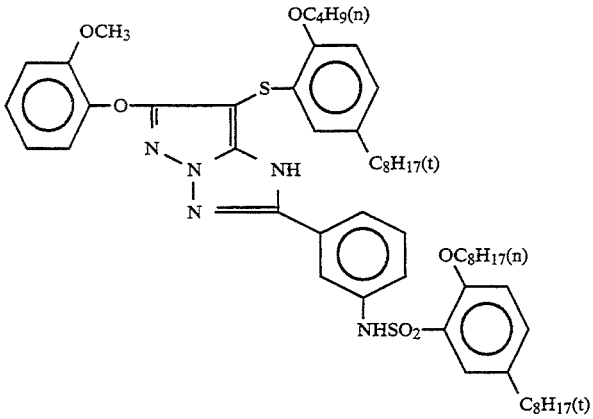
(M-4)
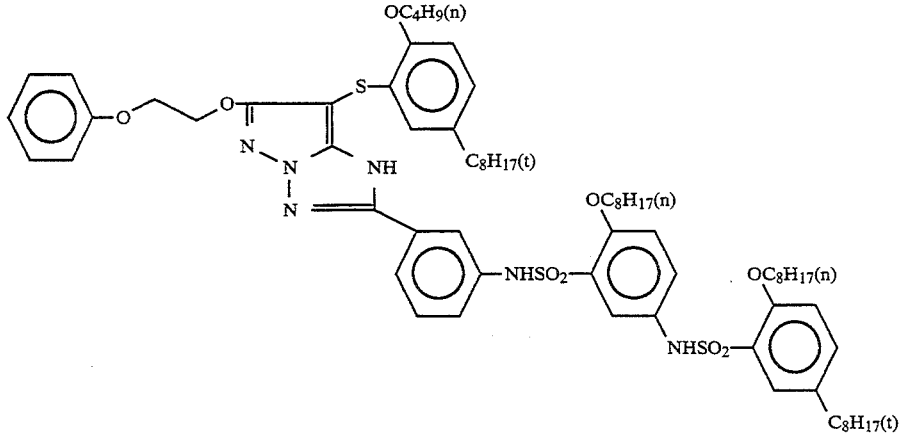

-continued
(M-5)
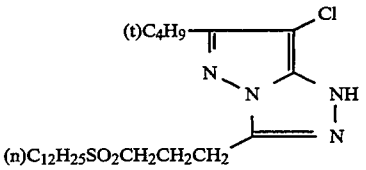
(M-6)
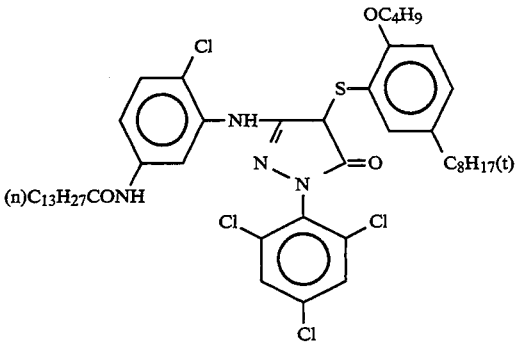
(M-7)
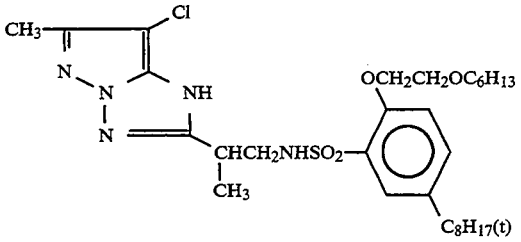
(M-8)
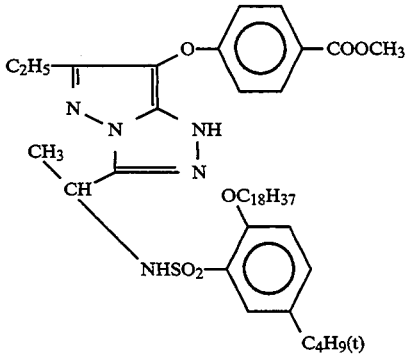
(M-9)
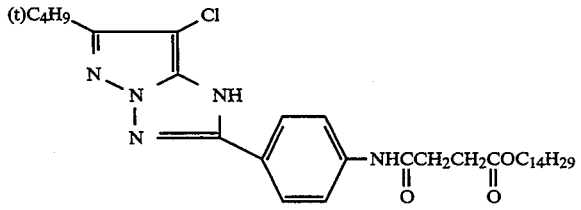
(C-1)
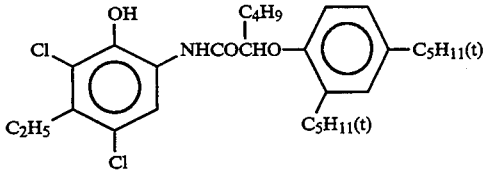

-continued
(C-2)
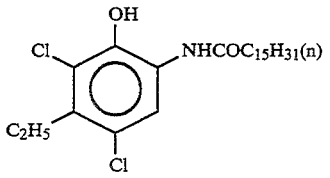
(C-3)
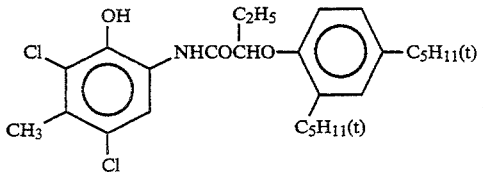
(C-4)
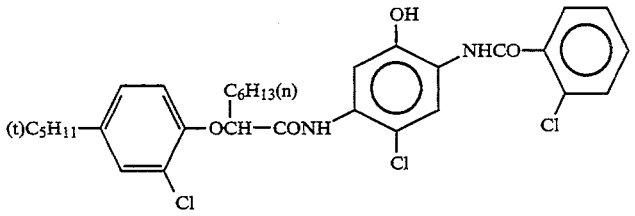
(C-5)
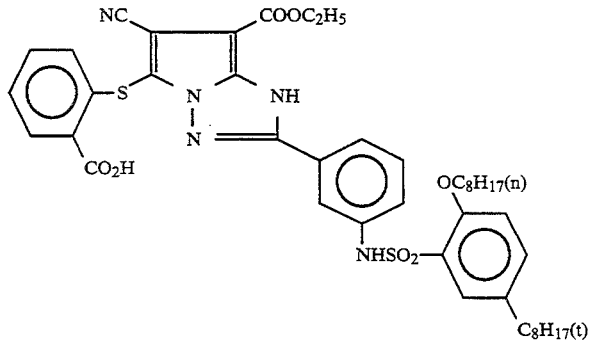
(C-6)
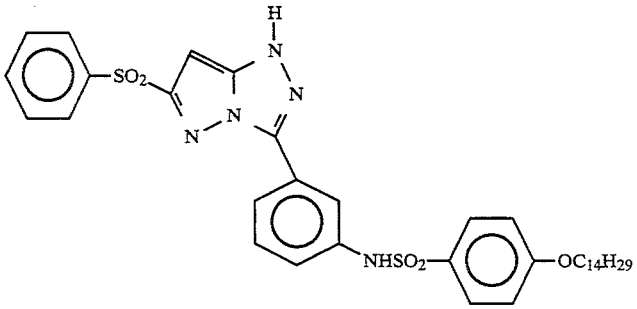
(C-7)
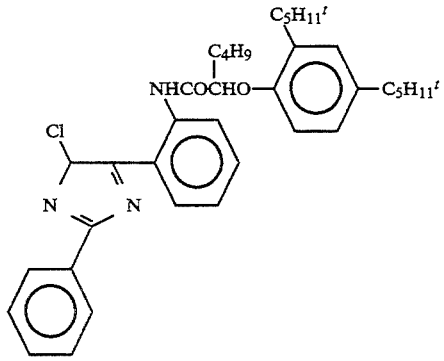

-continued (C-8)

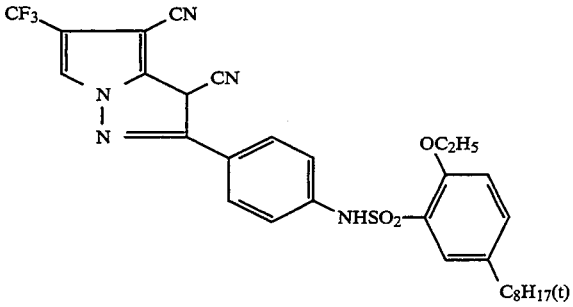

(C-9)

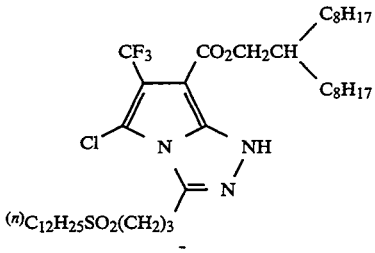

(C-10)

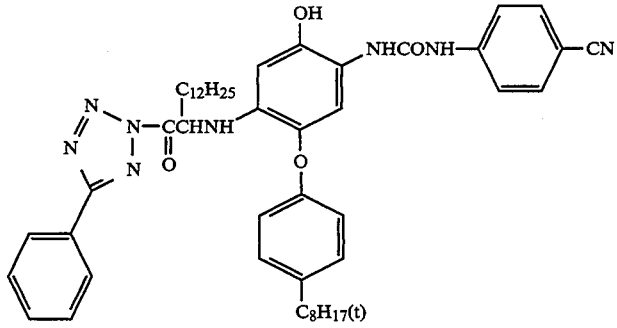

(C-11)

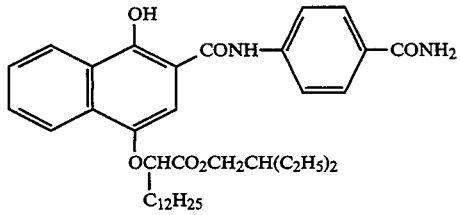

(C-12)

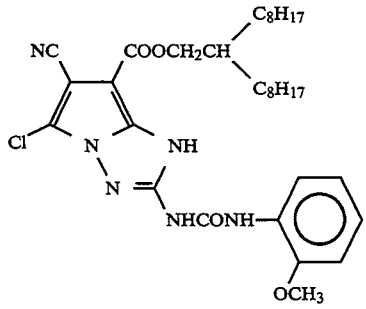

The photographic light-sensitive material of the present invention may further comprise various discoloration inhibitors. Examples of organic discoloration inhibitors for cyan, magenta and/or yellow images include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines, and ether or ester derivatives obtained by silylating or alkylating the phenolic hydroxyl group in these compounds. Further, metal complexes such as a (bis-salicylaldoximate)nickel complex and a (bis-N,N-dialkyldithiocarbamate)nickel complex, can be used.

Specific examples of such organic discoloration inhibitors include hydroquinones as disclosed in U.S. Pat. Nos. 2,360,290, 2,418,613, 2,700,453, 2,701,197, 2,728,659, 2,732,300, 2,735,765, 3,982,944, and 4,430,425, British Patent 1,363,921, and U.S. Pat. Nos. 2,710,801, and 2,816,028, 6-hydroxychromans, 5-hydroxychromans and spirochromans as disclosed in U.S. Pat. Nos. 3,432,300, 3,573,050, 3,574,627, 3,698,909, and 3,764,337, and JP-A-52-152225, spiroindanes as disclosed in U.S. Pat. No. 4,360,589, p-alkoxyphenols as disclosed in U.S. Pat. No. 2,735,765, British Patent 2,066,975, JP-A-59-10539, and JP-B-57-19765, hindered phenols as disclosed in U.S. Pat. Nos. 3,700,455, and 4,228,235, JP-A-52-72224, and JP-B-52-6623, gallic acid derivatives as disclosed in U.S. Pat. No. 3,457,079, methylenedioxybenzenes as disclosed in U.S. Pat. No. 4,332,886, aminophenols as disclosed in JP-B-56-21144, hindered amines as disclosed in U.S. Pat. No. 3,336,135, and 4,268,593, British Patents 1,326,889, 1,354,313, and 1,410,846, JP-B-51-1420, and JP-A-58-114036, JP-A-59-53846, and JP-A-59-78344, and metal complexes as disclosed in U.S. Pat. Nos. 4,050,938, and 4,241,155, and British Patent 2,027,731 (A). These compounds can each be incorporated in the photographic layer in an amount of 5 to 100% by weight of the respective color coupler in the form of emulsion with the color coupler to accomplish the object.

The photographic light-sensitive material of the present invention may comprise a hydroquinone derivative, aminophenol derivative, gallic acid derivative, ascorbic acid derivative, or the like, as a color fog inhibitor. The color fog inhibitor can be incorporated in an amount of 0.1 to 200 mol % based on the color coupler.

In order to inhibit the deterioration of a cyan dye image by heat, particularly by light, it is effective to incorporate an ultraviolet absorbent in the cyan coloring layer and its adjacent layers.

As such an ultraviolet absorbent there can be used an aryl-substituted benzotriazole compound (as disclosed in U.S. Pat. No. 3,533,794), 4-thiazolidone compound (as disclosed in U.S. Pat. Nos. 3,314,794 and 3,352,681), benzophenone compound (as disclosed in JP-A-46-2784), cinnamic ester compound (as disclosed in U.S. Pat. Nos. 3,705,805 and 3,707,395), butadiene compound (as disclosed in U.S. Pat. No. 4,045,229), triazine compound (as disclosed in JP-A-46-3335) or benzoxazole compound (as disclosed in U.S. Pat. No. 3,406,070 and 4,271,307). Alternatively, ultraviolet-absorbing couplers (e.g., α-naphtholic cyan dye-forming couplers) or ultraviolet-absorbing polymers, may be used. These ultraviolet absorbents may mordant specific layers. Particularly preferred among these ultraviolet absorbents is the foregoing aryl-substituted benzotriazole compound.

The photographic light-sensitive material according to the present invention may be developed by any ordinary method as described in the above cited RD Nos. 17643, pp. 28–29, and 18716, left column-right column on page 615. For example, a color development process, desilvering process, and rinsing process may be effected. In the desilvering process, a blix process with a blix solution may be effected instead of a bleaching process with a bleaching solution and fixing process with a fixing solution. Alternatively, a bleaching process, a fixing process and a blix process may be combined in an arbitrary order. A stabilizing process may be effected instead of a rinsing process. Alternatively, the stabilizing process may be effected after the rinsing process. Further, color development, bleaching and fixing can be effected in a monobath process with a combined developing, bleaching and fixing solution. Combined with these processing steps, a pre-film hardening process, a neutralizing process, a stop and fixing process, a post-film hardening process, an adjusting process, an intensifying process, etc., may be effected. A middle rinsing process may be arbitrarily provided between these processes. In these processes, a so-called activator processing may be effected instead of the color development process.

In the interest of brevity and conciseness, the contents of the aforementioned numerous patent documents and articles are hereby incorporated by reference documents.

The present invention will be further described using the following examples, but the invention should not be construed as being limited thereto.

EXAMPLE 1

11.5 g of a magenta coupler (M-1) was measured out. To the material was added 11.5 g of dibutyl phthalate as a high boiling organic solvent. To the material was then added 24 ml of ethyl acetate to make a solution. The solution thus obtained was then emulsion-dispersed in 200 g of a 10 wt. % aqueous solution of gelatin containing 1.5 g of sodium dodecylbenzenesulfonate.

The entire emulsion dispersion was then added to 247 g of a high silver chloride content emulsion (silver content: 70.0 g/kg of emulsion; silver bromide content: 0.5 mol %). The emulsion was then coated on an undercoated triacetate film base in such an amount that the coated amount of silver reached 1.73 g/m$^2$. On the coating layer was then coated a gelatin layer as a protective layer to a dry thickness of 1.0 μm to prepare Specimen 101. As a gelatin hardener there was used 1-oxy-3,5-dicyclo-s-triazine sodium salt.

Specimens 102 to 126 were prepared in the same manner as Specimen 101 except that the emulsion dispersion was prepared by emulsifying couplers and dye stabilizers (100 mol added based on coupler) in combination as set forth in Table A.

These photographic light-sensitive material specimens were exposed to light through an optical wedge, and then processed in accordance with the following procedures:

| Processing step | Temperature | Time |
|---|---|---|
| Color development | 35° C. | 45 sec. |
| Blix | 35° C. | 45 sec. |
| Rinsing (1) | 35° C. | 30 sec. |
| Rinsing (2) | 35° C. | 30 sec. |
| Rinsing (3) | 35° C. | 30 sec. |
| Drying | 80° C. | 60 sec. |

The rinsing step was effected in a countercurrent process wherein the rinsing solution flows backward.

The formulations of the various processing solutions were as follows:

| Color developer | |
|---|---|
| Water | 800 ml |
| Ethylenediaminetetraacetic acid | 3.0 g |
| Disodium 4,5-dihydroxybenzene-1,3-disulfonate | 0.5 g |
| Triethanolamine | 12.0 g |
| Sodium chloride | 2.5 g |
| Potassium bromide | 0.01 g |
| Potassium carbonate | 27.0 g |
| Fluorescent brightening agent (WHITEX 4 produced by Sumitomo Chemical Co., Ltd.) | 1.0 g |
| Sodium sulfite | 0.1 g |
| Disodium N,N-bis(sulfonateethyl) | 5.0 g |

-continued

| | |
|---|---|
| hydroxylamine | |
| N-ethyl-N-(A-methanesulfonamideethyl)-3-methyl-4-aminoaniline 3/2 sulfate monohydrate | 5.0 g |
| Water to make | 1,000 ml |
| pH (25° C./adjusted with potassium hydroxide and sulfuric acid) | 10.05 |
| Blix solution | |
| Water | 600 ml |
| Ammonium thiosulfate (700 g/l) | 100 ml |
| Ammonium sulfite | 40 g |
| Ferric ammonium ethylenediamine-tetraacetate | 55 g |
| Ethylenediaminetetraacetic acid | 5 g |
| Amonium bromide | 40 g |
| 67% Nitric acid | 30 g |
| Water to make | 1,000 ml |
| pH (25° C./adjusted with acetic acid and aqueous ammonia) | 5.8 |
| Rinsing solution | |
| Chlorinated sodium isocyanurate | 0.02 g |
| Deionized water (conductivity: 5 μs/cm or less) | 1,000 ml |
| pH | 6.5 |

Specimens 101 to 126 on which a dye image had been formed were then measured for magenta density to determine a ratio of maximum color density (Dmax) to that of the specimens free of dye stabilizer (Specimens 101, 113). These specimens were exposed to light (illuminance: 200,000 lux) from a xenon tester through an ultraviolet-absorbing filter for cutting light of 400 nm or less (available from Fuji Photo Film Co., Ltd.) for 10 days. These specimens were then determined for percentage remaining of 1.0 density.

The measurement was carried out by means of a self-recording densitometer available from Fuji Photo Film Co., Ltd.

The results are set forth in Table A.

TABLE A

| Specimen | Coupler | Dye image stabilizer | Maximum color density ratio | Percent density remaining (after 10 days of exposure to Xe at 200,000 lux; initial density: 1.0 |
|---|---|---|---|---|
| 101 | M-1 | — | 100% | 7% |
| 102 | M-1 | Comparative Compound (a) | 98% | 49% |
| 103 | M-1 | Comparative Compound (b) | 100% | 53% |
| 104 | M-1 | Comparative Compound (c) | 97% | 56% |
| 105 | M-1 | Comparative Compound (d) | 78% | 30% |
| 106 | M-1 | Comparative Compound (e) | 96% | 42% |
| 107 | M-1 | A-2 | 100% | 82% |
| 108 | M-1 | A-3 | 105% | 85% |
| 109 | M-1 | A-5 | 100% | 80% |
| 110 | M-1 | A-12 | 104% | 82% |
| 111 | M-1 | A-16 | 97% | 78% |
| 112 | M-1 | A-20 | 103% | 80% |
| 113 | M-7 | — | 100% | 8% |
| 114 | M-7 | Comparative Compound (a) | 98% | 48% |
| 115 | M-7 | Comparative Compound (b) | 100% | 50% |
| 116 | M-7 | Comparative Compound (c) | 98% | 53% |
| 117 | M-7 | Comparative Compound (d) | 68% | 27% |
| 118 | M-7 | Comparative Compound (e) | 95% | 38% |
| 119 | M-7 | A-3 | 100% | 82% |
| 120 | M-7 | A-4 | 104% | 80% |
| 121 | M-7 | A-6 | 101% | 84% |
| 122 | M-7 | A-7 | 103% | 80% |
| 123 | M-7 | A-10 | 98% | 77% |
| 124 | M-7 | A-12 | 100% | 81% |
| 125 | M-7 | A-3* | 99% | 85% |
| 126 | M-7 | A-4* | 102% | 84% |

*Additive (a) further added 10 mol % based on M-7 (Note: Specimens 101 to 106 and 113 to 118 are comparative while the others are according to the present invention)

Comparative Compound (a)

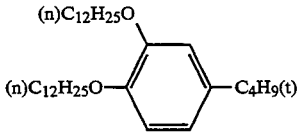

(Compound as disclosed in JP-B-61-46819)

Comparative Compound (b)

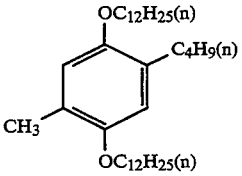

(Compound as disclosed in PJ-B-56-24257 and U.S. Pat. No. 4,254,216)

Comparative Compound (c)

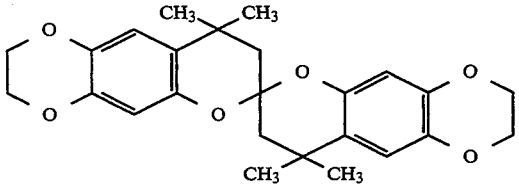

(Compound as disclosed in JP-A-56-52747)

Comparative Compound (d)

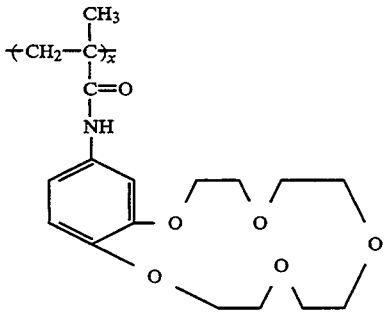

Number-average molecular weight: 27,000 (evaluated with x = 1 herein)
(Compound as disclosed in JP-A-62-284348)

Comparative Compound (e)

-continued

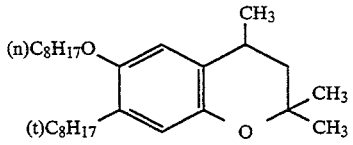

(Compound as disclosed in JP-A-60-262159)

Additive (a)

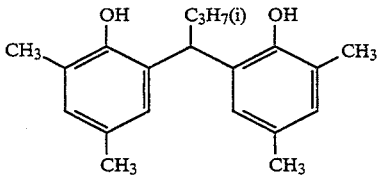

(Compound as disclosed in JP-A-2-139544)

The results show that the compounds disclosed in JP-B-61-46819 and JP-B-56-24257, and JP-A-56-52747 and JP-A-262159 leave much to be desired with respect to their capability of inhibiting discoloration.

The compound disclosed in JP-A-62-284348 (Comparative Compound (d)), which is a compound known to be incorporated in an undercoating layer to inhibit the production of spots caused by contamination with metals, is similar in structure to the compound of the present invention. This compound was evaluated as a discoloration inhibitor herein. The compound was confirmed to exert a reduced effect of inhibiting discoloration and worsen color developability.

On the other hand, the compound of the present invention was confirmed to unexpectedly exert an excellent effect of inhibiting discoloration by light without giving adverse effects on color developability.

EXAMPLE 2

Specimen 201 was prepared in the same manner as in Example 1 except that 11.5 g of the magenta coupler (M-1) was replaced by 16.1 g of a yellow coupler (Y-1) and the amount of dibutyl phthalate to be used as a high boiling organic solvent was changed from 11.5 g to 10.1 g.

Specimens 202 to 218 were prepared in the same manner as Specimen 201 except that the emulsion dispersion was prepared by emulsifying the couplers and dye stabilizers (added as 100 mol % based on coupler) in combination as set forth in Table B.

The specimens thus obtained were subjected to exposure, development and discoloration test (exposure was effected for 12 days) in the same manner as in Example 1. For evaluation of discoloration, percent remaining of yellow density from the initial density of 2.0 was determined. The results are set forth in Table B. As comparative compounds there were used the same compounds as used in Example 1.

TABLE B

| Specimen | Coupler | Dye image | stabilizer | Percent density remaining (after 10 days of exposure to Xe at 200,000 lux; initial density: 1.0 |
|---|---|---|---|---|
| 201 | Y-1 | — | | 43 |
| 202 | " | Comparative Compound (a) | | 47 |

TABLE B-continued

| Specimen | Coupler | Dye image | stabilizer | Percent density remaining (after 10 days of exposure to Xe at 200,000 lux; initial density: 1.0 |
|---|---|---|---|---|
| 203 | " | Comparative Compound (b) | | 51 |
| 204 | " | Comparative Compound (c) | | 45 |
| 205 | " | Comparative Compound (d) | | 52 |
| 206 | " | Comparative Compound (e) | | 44 |
| 207 | " | A-2 | | 77 |
| 208 | " | A-3 | | 79 |
| 209 | " | A-5 | | 76 |
| 210 | " | A-12 | | 80 |
| 211 | Y-3 | — | | 10 |
| 212 | " | Comparative Compound (c) | | 25 |
| 213 | " | Comparative Compound (d) | | 24 |
| 214 | " | Comparative Compound (e) | | 20 |
| 215 | " | A-3 | | 76 |
| 216 | " | A-4 | | 74 |
| 217 | " | A-7 | | 75 |
| 218 | " | A-20 | | 73 |

These results show that the compounds used according to the present invention is also unexpectedly effective to inhibit the discoloration of a yellow dye image by light.

A xenon discoloration test was effected in the same manner as in Example 1 with the discoloration inhibitors set forth in Table A, except that the magenta coupler was replaced by the cyan coupler (C-12). As a result, it was confirmed that the compound of the present invention exerts an excellent effect of inhibiting discoloration.

EXAMPLE 3

The surface of a polyethylene double-laminated paper support was subjected to corona discharge. On the paper support was provided a gelatin undercoating layer containing sodium dodecylbenzenesulfonate. On the undercoating layer, various photographic constituent layers were coated to prepare a multilayer color photographic paper having the following layer construction (Specimen 001). The coating solutions were prepared as follows:

Preparation of 1st layer coating solution 158.0 g of a yellow coupler (ExY), 15.0 g of a dye stabilizer (Cpd-1), 7.5 g of a dye stabilizer (Cpd-2) and 16.0 g of a dye stabilizer (Cpd-3) were dissolved in 25 g of a solvent (Solv-1), 25 g of a solvent (Solv-2) and 180 cc of ethyl acetate in combination. The solution was then emulsion-dispersed in 1,000 g of a 10% aqueous solution of gelatin containing 60 cc of 10% sodium dodecylbenzenesulfonate and 10 g of citric acid to prepare an emulsion dispersion A. On the other hand, a silver bromochloride emulsion A was prepared using a 3:7 (Ag molar ratio) mixture of a large size emulsion A of cubic grains having an average size of 0.88 μm with a grain size distribution fluctuation coefficient of 0.08, and a small size emulsion A of cubic grains having an average size of 0.70 μm with a grain size distribution fluctuation coefficient of 0.10, 0.3 mol % of silver bromide being localized partially on the surface of each emulsion. This emulsion comprised blue-sensitive sensitizing dyes A and B having the chemical structure set forth below in an amount of $2.0\times10^{-4}$ mol per mol of Ag for the large size emulsion A and $2.5\times10^{-4}$ mol per mol of Ag for the small size emulsion A, respectively. The chemical ripening of this emulsion was carried out by the addition of a sulfur sensitizer and a gold sensitizer. The previously prepared emulsion dispersion A and the red-sensitive silver bromochloride emulsion A were mixed to prepare a coating solution for the 1st layer having the formulations set forth below. The coated amount of emulsion was calculated in terms of silver.

The coating solutions for the 2nd layer to the 7th layer were prepared in the same manner as the coating solution for the 1st layer. As gelatin hardener for each layer there was used sodium salt of 1-oxy-3,5-dichloro-s-triazine.

Cpd-14 and Cpd-15 were added to each of these layers a total amount of 25.0 mg/m$^2$ and 50.0 mg/m$^2$, respectively.

The silver bromochloride emulsion to be incorporated in the photographic emulsion layers comprised the following spectral sensitizing dyes:

Blue-sensitive emulsion layer
Sensitizing dye A

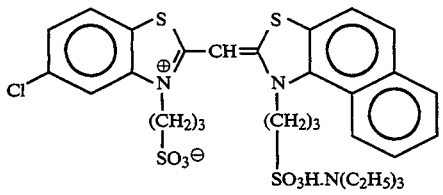

and

Sensitizing dye B

-continued

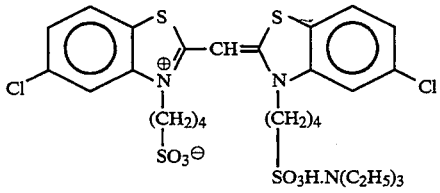

$2.0\times10^{-4}$ mol each for large size emulsion, and $2.5\times10^{-4}$ mol each for small size emulsion per mol of silver halide was used.

Green-sensitive emulsion layer

Sensitizing dye C

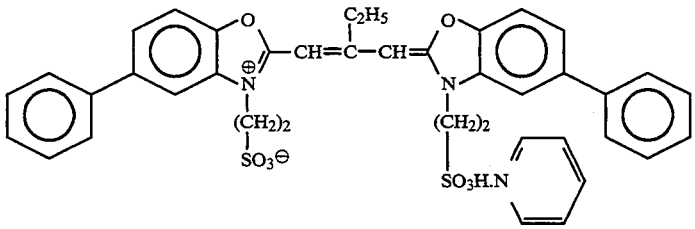

$4.0\times10^{-4}$ mol each for large size emulsion and $5\text{-}6\times10^{-4}$ mol each for small size emulsion per mol of silver halide were used and Sensitizing dye D

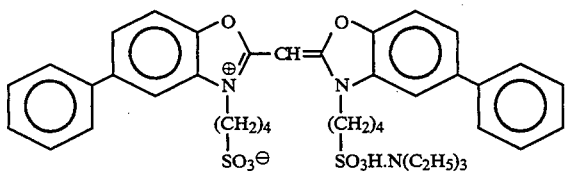

$7.0\times10^{-4}$ mol each for large size emulsion and $1.0\times10^{-4}$ mol each for small size emulsion per mol of silver halides were used.

Sensitizing dye E

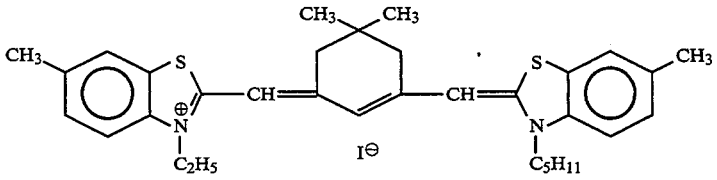

$0.9\times10^{-4}$ mol each for large size emulsion and $1.1\times-4$ mol each for small size emulsion per mol of silver halide were used.

Further, the red-sensitive emulsion layer comprised the following compound F in an amount of $2.5\times10^{-3}$ mol per mol of silver halide.

Sensitizing dye F

-continued

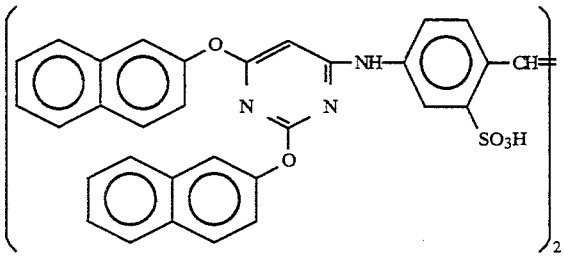

To the blue-sensitive emulsion layer, the green-sensitive emulsion layer and the red-sensitive emulsion layer were each added 1-(5-methylureidephenyl)-5-mercaptotetrazole in an amount of $8.5\times10^{-5}$ mol, $7.7\times10^{-4}$ mol and $2.5\times10^{-4}$ mol per mol of silver halide, respectively. To the blue-sensitive emulsion layer and the green-sensitive emulsion layer were each added 4-hydroxy-6-methyl-1,3,3a,7-tetrazaindene in an amount of $1.0\times10^{-4}$ mol and $2.0\times10^{-4}$ mol per mol of silver halide, respectively.

For the purpose of inhibiting irradiation, the following dyes were added to each of the emulsion layers (figures in the parenthesis indicate the coated amount):

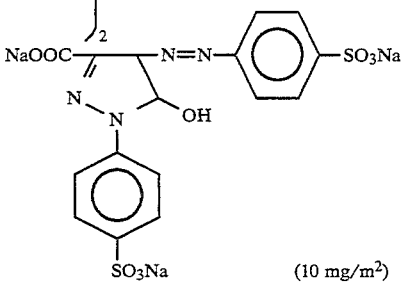

(10 mg/m²)

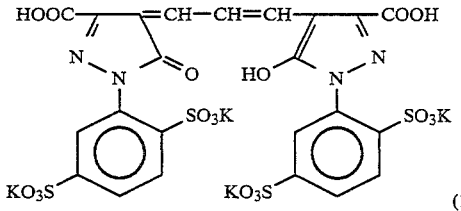

(10 mg/m²)

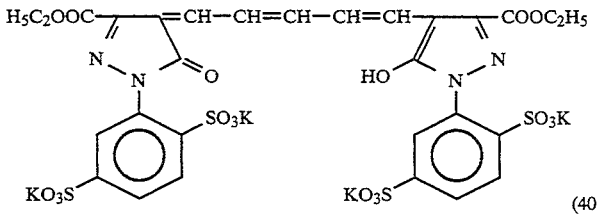

(40 mg/m²)

and

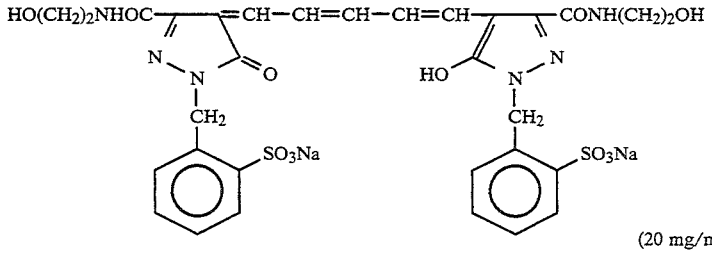

(20 mg/m²)

Layer construction

The formulations of the various layers are set forth below. The figures indicate the coated amount (g/m²). The coated amount of silver halide emulsion is represented as being calculated in terms of silver.

Support

Polyethylene-laminated paper which contained a white pigment ($TiO_2$) and a blue dye (ultramarine) in polyethylene on the 1st layer side.

| 1st layer (blue-sensitive emulsion layer) | |
|---|---|
| Silver bromochloride emulsion A as set forth above | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |

-continued

| | |
|---|---|
| Dye image stabilizer (Cpd-3) | 0.08 |
| Solvent (Solv-1) | 0.13 |
| Solvent (Solv-2) | 0.13 |
| 2nd layer (color, mixing prevention layer) | |
| Gelatin | 1.00 |
| Color stain inhibitor (Cpd-4) | 0.06 |
| Solvent (Solv-7) | 0.03 |
| Solvent (Solv-2) | 0.25 |
| Solvent (Solv-3) | 0.25 |
| 3rd layer (green-sensitive emulsion layer) | |
| Silver bromochloride emulsion (cube; 1:3 (Ag molar ratio) mixture of a large size emulsion B having an average size of 0.55 μm with a grain size distribution variation coefficient of 0.10 and a small size emulsion B having an average size of 0.39 μm with a grain size distribution variation coefficient of 0.08, 0.8 mol % of silver bromide being localized partially on the surface of grains) | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| 4th layer (color mixing prevention layer) | |
| Gelatin | 0.70 |
| Color stain inhibitor (Cpd-4) | 0.04 |
| Solvent (Solv-7) | 0.02 |
| Solvent (Solv-2) | 0.18 |
| Solvent (Solv-3) | 0.18 |
| 5th layer (red-sensitive emulsion layer) | |
| Silver bromochloride emulsion (cube; 1:3 mixture (Ag molar ratio) of a large size emulsion C having an average grain size of 0.50 μm and a grain size variation coefficient of 0.09, and a small size emulsion C having an average grain size of 0.41 μm and a grain size variation coefficient of 0.11, 0.8 mol % of silver bromide being localized partially on the surface of grains) | 0.20 |
| Gelatin | 0.85 |
| Cyan coupler (ExC) | 0.33 |
| Ultraviolet absorbent (UV-2) | 0.18 |
| Dye image stabilizer (Cpd-1) | 0.30 |
| Dye image stabilizer (Cpd-9) | 0.01 |
| Dye image stabilizer (Cpd-10) | 0.01 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| 6th layer (ultraviolet absorbing layer) | |
| Gelatin | 0.55 |
| Ultraviolet absorbent (UV-1) | 0.38 |
| Dye image stabilizer (Cpd-12) | 0.15 |
| Dye image stabilizer (Cpd-5) | 0.02 |
| 7th layer (protective layer) | |
| Gelatin | 1.13 |
| Acryl-modified copolymer of polyvinyl alcohol (modification degree: 17%) | 0.05 |
| Liquid paraffin | 0.02 |
| Dye image stabilizer (Cpd-13) | 0.01 |

Yellow coupler (ExY)

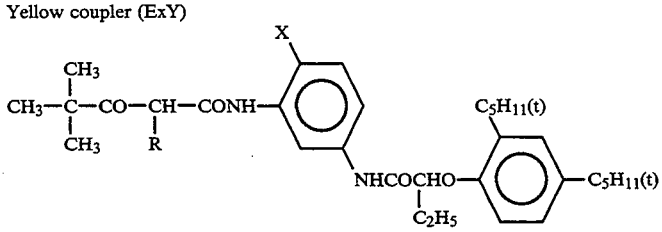

1:1 (molar ratio) mixture of:

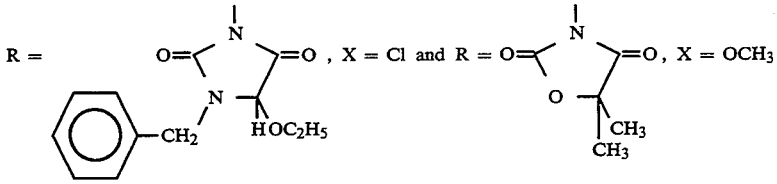

-continued
Magenta coupler (ExM)
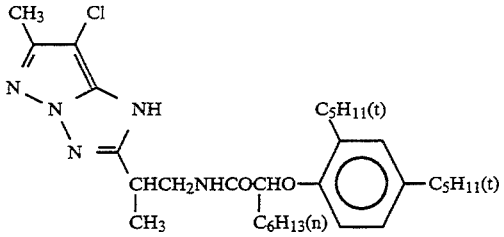
Cyan coupler (ExC)
3:7 mixture (molar ratio) of:
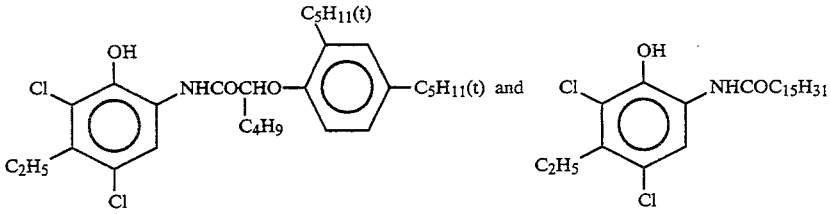
Dye image stabilizer (Cpd-1)
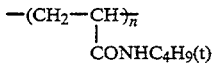
Average molecular weight: 60,000
Dye image stabilizer (Cpd-2)
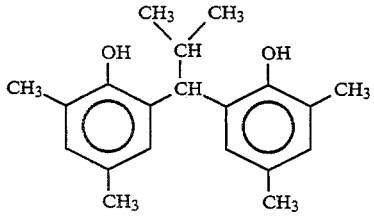
Dye image stabilizer (Cpd-3)
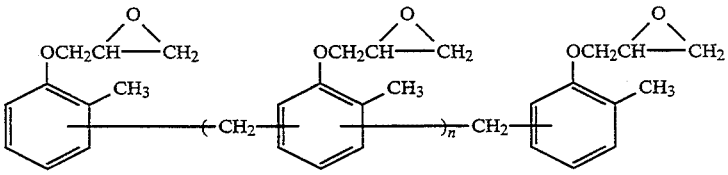
n = 7 to 8 (average value)
Color stain inhibitor (Cpd-4)
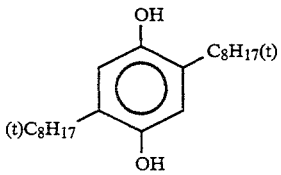
Dye image stabilizer (Cpd-5)
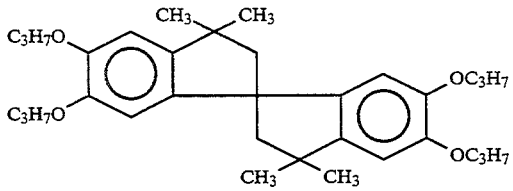
Dye image stabilizer (Cpd-6)

-continued
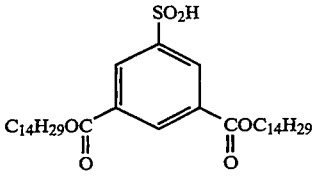
Dye image stabilizer (Cpd-7)
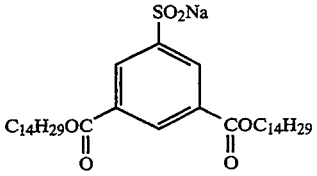
Dye image stabilizer (Cpd-8)
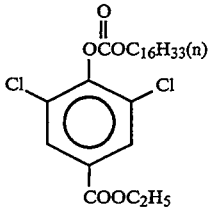
Dye image stabilizer (Cpd-9)
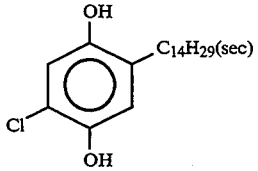
Dye image stabilizer (Cpd-10)
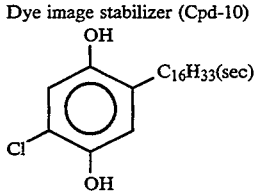
Dye image stabilizer (Cpd-11)
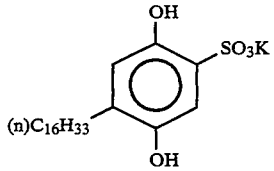
Dye image stabilizer (Cpd-12)
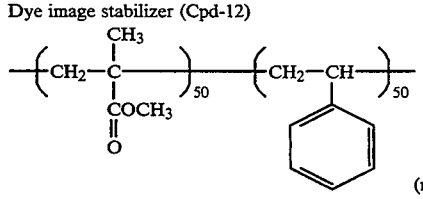
(mol ratio)
Average molecular weight: approx. 60,000
Dye image stabilizer (Cpd-13)
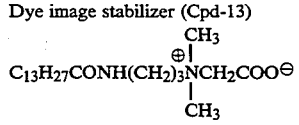
Preservative (Cpd-4)

-continued
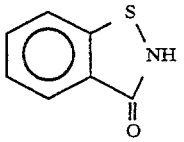
Preservative (Cpd-15)
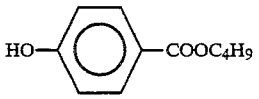
Solvent (Solv-1)
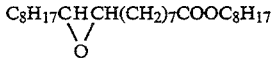
Solvent (Solv-2)
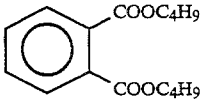
Solvent (Solv-3)
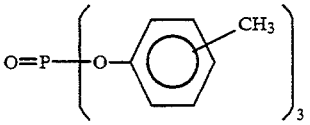
Solvent (Solv-4)
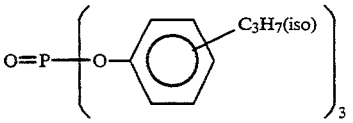
Solvent (Solv-5)
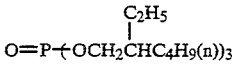
Solvent (Solv-6)
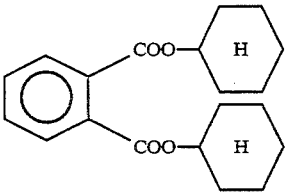
Solvent (Solv-7)
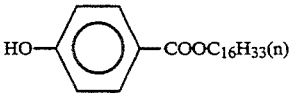
Ultraviolet absorbent (UV-1)
1:5:10:5 mixture (by weight) of:
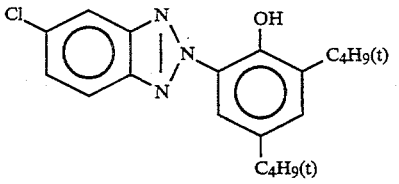
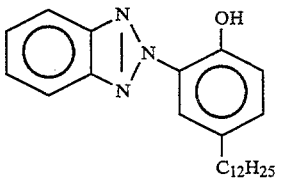

-continued

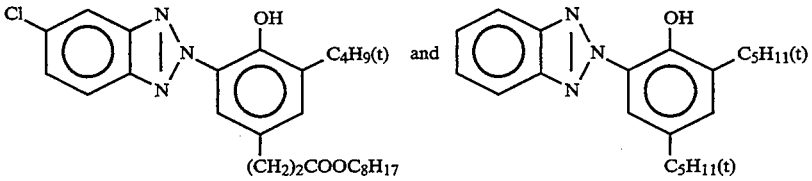

Ultraviolet absorbent (UV-2)
1:2:2 mixture (by weight) of:

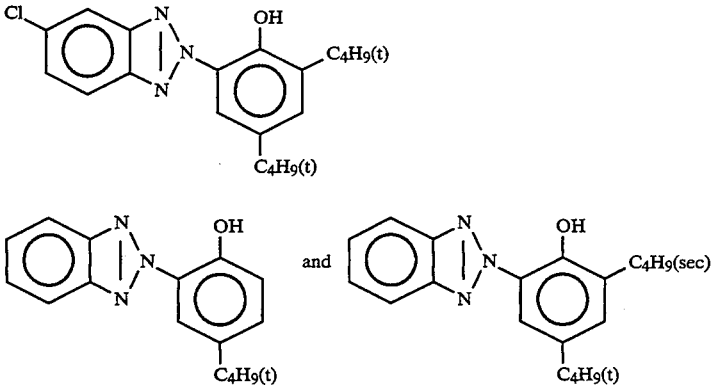

Specimens 002 to 008 were prepared in the same manner as Specimen 001 except a dye image stabilizer as set forth Table C was added to the yellow coupler ExY and dye stabilizer (cpd-2) to be incorporated in the 1st layer as 100 mol % based on the yellow coupler. The type of couplers and dye stabilizers contained in these specimens are set forth in Table C.

Specimen 001 was exposed to gray light by means of a sensitometer (Type FWH sensitometer available from Fuji Photo Film Co., Ltd.; color temperature of light source: 3,200° K.) in such a manner that about 30% by weight of the coated amount of silver was developed.

The specimens which had been exposed to light were then subjected to continuous processing with the following processing solutions by means of a paper processing machine in accordance with the following processing procedures. Thus, a running equilibrium was established in the development process.

| Processing step | Temperature | Time | Replenisher* | Tank capacity |
|---|---|---|---|---|
| Color development | 35 ° C. | 45 sec. | 161 ml | 17 l |
| Blix | 30–35 ° C. | 45 sec. | 215 ml | 17 l |
| Rinsing | 30 ° C. | 90 sec. | 350 | 10 l |
| Drying | 70–80 ° C. | 60 sec. | | |

*per $m^2$ of photographic light-sensitive material

The formulations of the various processing solutions were as follows:

| Color developer | Tank solution | Replenisher |
|---|---|---|
| Water | 800 ml | 800 ml |
| Ethylenediamine-N,N,N1,N1-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |

-continued

| Color developer | Tank solution | Replenisher |
|---|---|---|
| N-ethyl-N-(A-methanesulfonamide-ethyl)-3-methyl-4-aminoaniline sulfate | 5.0 g | 7.0 g |
| N,N-bis(carboxymethyl)hydrazine | 4.0 g | 5.0 g |
| N-N-di(sulfoethyl)hydroxylamine-1Na | 4.0 g | 5.0 g |
| Fluorescent brightening agent (WHITEX 4B produced by Sumitomo Chemical Co., Ltd.) | 1.0 g | 2.0 g |
| Water to make | 1000 ml | 1,000 ml |
| pH (25 ° C.) | 10.05 | 10.45 |

| Blix solution (tank solution was used as replenisher) | |
|---|---|
| Water | 400 ml |
| Ammonium thiosulfate (700 g/l) | 100 ml |
| Sodium sulfite | 17 g |
| Ferric ammonium ethylenediamine-tetraacetate | 55 g |
| Disodium ethylenediaminetetraacetate | 5 g |
| Ammonium bromide | 40 g |
| Water to make | 1,000 ml |
| pH (25 ° C.) | 6.0 |

Rinsing solution (running solution was used also as replenisher)
Ion-exchanged water (calcium and magnesium concentrations: 3 ppm or less each)

Specimens 001 to 008 were subjected to imagewise exposure through a three color separation optical wedge, and then processed with the foregoing processing solutions.

These specimens on which a dye image had been formed were then subjected to discoloration test. For evaluation of the effect of inhibiting discoloration, the percentage remaining of yellow density at the initial density of 2.0 after 10 days of exposure to light (illuminance: 200,000 lux) from a xenon tester was determined.

The results are set forth in Table C.

TABLE C

| Specimen | Coupler | Dye image | stabilizer | Percent density remaining (after 10 days of exposure to Xe at 200,000 lux; initial density: 1.0 |
|---|---|---|---|---|
| 001 | ExY | — | | 48 |
| 002 | " | Comparative Compound (c) | | 52 |
| 003 | " | Comparative Compound (d) | | 50 |
| 004 | " | Comparative Compound (e) | | 48 |
| 005 | " | A-3 | | 82 |
| 006 | " | A-4 | | 80 |
| 007 | " | A-7 | | 83 |
| 008 | " | A-12 | | 79 |

(Note: Specimens 001 to 004 are comparative while the others are according to the present invention)

The above results show that the compound of the present invention can exert its effect of inhibiting discoloration even with multi-layer photographic light-sensitive materials.

EXAMPLE 4

Specimens were prepared in the same manner as Specimen 101 of Example 1 in JP-A-2-854 except that compounds (A-2), (A-3), (A-7), (A-12) and (A-20) according to the invention were incorporated in the 12th and 13th layers in an amount of 25 mol % based on the couplers to be incorporated therein in the form of emulsion therewith, respectively.

Further, specimens were prepared in the same manner as Specimen 101 except that the compounds (A-3), (A-4), (A6), (A-14) and (A-16) according to the invention were incorporated in the 7th, 8th and 9th layers in an amount of 25 mol % based on the couplers to be incorporated therein in the form of emulsion therewith, respectively.

These specimens were then subjected to exposure, development and discoloration tests in the same manner as in Example 1 of JP-A-2-854. The specimens according to the present invention exhibited an excellent effect of inhibiting discoloration, as well as excellent photographic properties.

It was thus found that the compound of the present invention exerts excellent effects even with these photographic light-sensitive materials.

EXAMPLE 5

Specimens were prepared in the same manner as the color photographic light-sensitive material of Example 2 in JP-A-l-158431, except that Cpd-9 to be incorporated in the 6th layer and 7th layer was replaced by compounds (A-1), (A-3), (A-4), (A-7) and (A-20) according to the invention in the equimolecular amount, respectively.

Further, specimens were prepared in the same manner as the color photographic light-sensitive material of Example 2 in JP-A-1-158431, except that Cpd-6 to be incorporated in the 11th layer and 12th layer was replaced by compounds (A-2), (A-4), (A-7), (A-14) and (A-20) according to the invention in the equimolecular amount, respectively.

These specimens were then subjected to exposure, development and discoloration tests and measured for photographic properties in the same manner as in Example 2 of JP-A-1-158431. The specimens according to the present invention exhibited an excellent effect of inhibiting discoloration, as well as excellent photographic properties.

It was thus found that the compound of the present invention exerts excellent effects even with these photographic light-sensitive materials.

The compound of the present invention represented by the general formula (A) exerts an excellent effect of improving fastness to light without adversely affecting color developability.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one layer containing at least one compound represented by the formula:

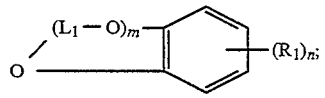

(A)

wherein $L_1$ is an alkylene or arylene group, $R_1$ has no more than 50 carbon atoms and represents a substituent which can be substituted for a hydrogen of the benzene ring; m is an integer of from 2 to 7, and n represents 0 or an integer of from 1 to 4, with the proviso that when m is at least 2, the plurality of $L_1$ groups may be the same or different, when n is 1, $R_1$ has 8 to 36 carbon atoms, when n is 2 to 4, at least one $R_1$ group has 8 to 36 carbon atoms, when n is at least 2, the plurality of $R_1$ groups may be the same or different.

2. A silver halide color photographic material according to claim 1, wherein n is an integer of 1 to 4.

3. A silver halide color photographic material according to claim 1, wherein $R_1$ represents a substituent selected from the group consisting of an aliphatic group, an aromatic group, a heterocyclic group, an aliphatic acyl group, an aromatic acyl group, an aliphatic acyloxy group, an aromatic acyloxy group, an aliphatic acylamino group, an aromatic acylamino group, an aliphatic oxy group, an aromatic oxy group, a heterocyclic oxy group, an aliphatic oxycarbonyl group, an aromatic oxycarbonyl group, a heterocyclic oxycarbonyl group, an aliphatic carbamoyl group, an aromatic carbamoyl group, an aliphatic sulfonyl group, an aromatic sulfonyl group, an aliphatic sulfonyloxy group, an aromatic sulfonyloxy group, an aliphatic sulfamoyl group, an aromatic sulfamoyl group, an aliphatic sulfonamido group, an aromatic sulfonamido group, an aliphatic amino group, an aromatic amino group, an aliphatic sulfinyl group, an aromatic sulfinyl group, an aliphatic thio group, an aromatic thio group, an hydroxyl group, a cyano group, a nitro group, a hydroxylamino group, an aliphatic carbamoylamino group, an aromatic carbamoylamino group, an aliphatic sulfamoylamino group, an aromatic sulfamoylamino group, and a halogen atom.

4. A silver halide color photographic material according to claim 1, wherein a compound represented by formula (A) is a lipophilic compound.

5. A silver halide color photographic material according to claim 4, wherein said lipophilic compound exhibits a water solubility of from 0 to 5% at room temperature (25° C.).

6. A silver halide color photographic material according to claim 1, wherein $R_1$ represents a substituent selected from the group consisting of an alkyl group, a 5- or 6-membered nitrogen-containing heterocyclic group connected to the benzene ring via a nitrogen atom, an alkylacylamino group, an arylacylamino group, an alkoxy group, an aryloxy group, an alkylsulfonamido group, an arylsulfonamido group, a hydroxyl group, an alkylcarbamoylamino group, an arylcarbamoylamino group, an alkylsulfamoylamino group, and a halogen atom.

7. A silver halide color photographic material according to claim 1, wherein n is 1 or 2.

8. A silver halide color photographic material according to claim 1, wherein m is integer of from 2 to 5.

9. A silver halide color photographic material according to claim 1, wherein m is 4 or 5.

10. A silver halide color photographic material according to claim 1, wherein m is 5.

11. A silver halide color photographic material according to claim 1, wherein said compound is represented by the following formula (A-I):

(A-I)

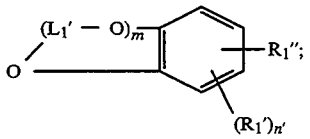

wherein $L_1'$ represents an alkylene or arylene group which carbon atom number contributing to a bonding distance between adjacent oxygen atoms in the unit ether linkage $—L_1'—O—_m$ is 2 or 3, $R_1'$ represents a group having no more than 50 carbon atoms which can be substituted for a hydrogen of the benzene ring, $R_1''$ represents a group having 6 to 50 carbon atoms which can be substituted for a hydrogen of the benzene ring, m is an integer of from 2 to 7, an n' is 0 or an integer of from 1 to 3, with proviso that when m is at least 2, the plurality of $L_1'$ groups may be the same or different, and when n' is at least 2, the plurality of $R_1'$ groups may be the same or different.

12. A silver halide color photographic material according to claim 11, wherein $L_1'$ represents an alkylene or arylene group which carbon atom number contributing to a bonding distance between adjacent oxygen atoms in the unit ether linkage $-(L_1'—O)-_m$ is 2.

13. A silver halide color photographic material according to claim 12, wherein said $L_1'$ group is ethylene, a 1-substituted ethylene or a substituted or unsubsituted o-phenylene group.

14. A silver halide color photographic material according to claim 11, wherein said compound is represented by the following formula (A-II):

(A-II)

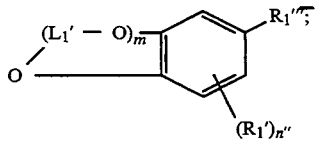

wherein $L_1'$, $R_1'$, and m are defined the same as in connection with formula (A-I), $R_1'''$ represents a $C_{6-50}$ alkylacylamino group, a $C_{6-50}$ arylacylamino group, a $C_{6-50}$ alkylsulfonamido group, a $C_{6-50}$ arylsulfonamido group, a $C_{6-50}$ alkylcarbamoylamino group, a $C_{6-50}$ arylcarbamoylamino group, a $C_{6-50}$ alkylsulfamoylamino group, or a $C_{6-50}$ 5-membered nitrogen-containing heterocyclic, or 6-membered nitrogen-containing heterocyclic group connected to the benzene ring through a nitrogen atom, and n'' is 0 or an integer 1 or 2, with the proviso that when m is at least 2, the plurality of $L_1'$ groups may be the same or different, and when n'' is 2, the plurality of $R_1'$ groups may be the same or different.

15. A silver halide color photographic material according to claim 1, wherein a compound of formula (A) is incorporated into a photographic silver halide emulsion layer.

16. A silver halide color photographic material according to claim 15, wherein said silver halide emulsion layer further comprises a dye-forming coupler, a compound formula (A) being coated in the form of an emulsion with said dye-forming coupler.

* * * * *